US009938809B2

(12) United States Patent
Okoniewski et al.

(10) Patent No.: US 9,938,809 B2
(45) Date of Patent: Apr. 10, 2018

(54) APPARATUS AND METHODS FOR ENHANCING PETROLEUM EXTRACTION

(71) Applicant: ACCELEWARE LTD., Calgary (CA)

(72) Inventors: Michal M. Okoniewski, Calgary (CA); Jorgen S. Nielsen, Calgary (CA)

(73) Assignee: ACCELEWARE LTD., Calgary (CA)

( * ) Notice: Subject to any disclaimer, the term of this patent is extended or adjusted under 35 U.S.C. 154(b) by 599 days.

(21) Appl. No.: 14/508,423

(22) Filed: Oct. 7, 2014

(65) Prior Publication Data

US 2016/0097268 A1 Apr. 7, 2016

(51) Int. Cl.
*E21B 43/24* (2006.01)
*E21B 47/00* (2012.01)

(52) U.S. Cl.
CPC ..... *E21B 43/2401* (2013.01); *E21B 47/00* (2013.01)

(58) Field of Classification Search
CPC ..... E21B 43/2401; E21B 47/00; E21B 43/16
See application file for complete search history.

(56) References Cited

U.S. PATENT DOCUMENTS

| | | | | |
|---|---|---|---|---|
| 2,757,738 A | | 8/1956 | Ritchey | |
| 3,169,577 A | | 2/1965 | Sarapuu | |
| 3,170,519 A | | 2/1965 | Haagensen | |
| 3,522,848 A | * | 8/1970 | New | E21B 43/2401 166/303 |
| 4,135,579 A | | 1/1979 | Rowland et al. | |
| 4,140,179 A | | 2/1979 | Kasevich et al. | |
| 4,301,865 A | | 11/1981 | Kasevich et al. | |
| 4,487,257 A | | 12/1984 | Dauphine | |
| 4,508,168 A | | 4/1985 | Heeren | |
| 4,513,815 A | | 4/1985 | Rundell et al. | |
| 4,583,589 A | | 4/1986 | Kasevich | |
| 4,620,593 A | | 11/1986 | Haagensen | |
| 5,293,936 A | | 3/1994 | Bridges | |

(Continued)

FOREIGN PATENT DOCUMENTS

| | | |
|---|---|---|
| CA | 2816297 | 11/2010 |
| CA | 2816101 | 5/2012 |

(Continued)

OTHER PUBLICATIONS

Written Opinion and International Search Report dated Dec. 15, 2015 in corresponding PCT Application No. PCT/CA2015/051009.

(Continued)

*Primary Examiner* — Caroline N Butcher
(74) *Attorney, Agent, or Firm* — Bereskin & Parr LLP/S.E.N.C.R.L., s.r.l.; Isis E. Caulder

(57) ABSTRACT

An apparatus and method for the extraction of hydrocarbons from an underground reservoir using a well is disclosed. The apparatus comprises a power source operable to supply periodic electrical power at a first frequency; at least one impulse generator unit operable to convert the periodic electrical power at the first frequency into periodic electrical power at a second frequency and to couple electromagnetic energy generated by the periodic electrical power at the second frequency into the reservoir, the second frequency being at least ten times higher than that of the first frequency; and a conducting cable being operatively coupled between the power source and the at least one impulse generator unit.

32 Claims, 12 Drawing Sheets

(56) References Cited

U.S. PATENT DOCUMENTS

| | | | | |
|---|---|---|---|---|
| 6,189,611 | B1 | 2/2001 | Kasevich | |
| 6,285,014 | B1 | 9/2001 | Beck et al. | |
| 7,075,392 | B2 | 7/2006 | Smith et al. | |
| 7,312,428 | B2 | 12/2007 | Kinzer | |
| 7,817,101 | B2 | 10/2010 | Cowles | |
| 7,891,421 | B2 | 2/2011 | Kasevich | |
| 8,453,739 | B2 | 6/2013 | Parsche | |
| 2001/0011590 | A1 | 8/2001 | Thomas et al. | |
| 2004/0084442 | A1 | 5/2004 | La Rovere | |
| 2006/0102625 | A1 | 5/2006 | Kinzer | |
| 2007/0252568 | A1* | 11/2007 | Chien | H02M 1/44 323/284 |
| 2009/0173488 | A1 | 7/2009 | Varma | |
| 2011/0006055 | A1 | 1/2011 | Diehl | |
| 2011/0042063 | A1 | 2/2011 | Diehl et al. | |
| 2011/0094755 | A1* | 4/2011 | Corbett | E21B 23/06 166/387 |
| 2011/0253367 | A1* | 10/2011 | Banerjee | E21B 43/2406 166/272.3 |
| 2012/0018140 | A1 | 1/2012 | Parsche | |
| 2012/0125609 | A1* | 5/2012 | Parsche | E21B 43/2401 166/272.1 |
| 2014/0262225 | A1 | 9/2014 | Campbell et al. | |

FOREIGN PATENT DOCUMENTS

| | | | |
|---|---|---|---|
| WO | 2008/115359 | A1 | 9/2008 |
| WO | 2012067769 | A2 | 5/2012 |

OTHER PUBLICATIONS

Bernd Wacker et al., Electromagnetic Heating for In-Situ Production of Heavy Oil and Bitumen Reservoirs, Society of Petroleum Engineers, 2011, pp. 1-14, Calgary, Canada.

Extended European Search Report dated Aug. 10, 2017 in corresponding EP Patent Application No. 15849646.3.

* cited by examiner

APPARATUS AND METHODS FOR ENHANCING PETROLEUM EXTRACTION

FIELD

The present subject-matter relates to apparatus and methods far enhancing the extraction of hydrocarbons from an underground reservoir.

BACKGROUND OF THE INVENTION

The extraction of hydrocarbons can be enhanced through the heating of shale oil, heavy oil, oil sand, or carbonate rock reservoirs with electromagnetic (EM) radiation in the radio frequency (RF) range. This is normally called "RF heating" and is generally implemented using a radiating element, located in the reservoir, to radiate an electromagnetic RF field (i.e. modulated at frequencies between 10 kHz to 100 MHz) into the reservoir, RF heating can typically allow for deeper and faster heat penetration than known steam-assisted technologies and can be implemented with simpler surface infrastructure. In addition, RF heating technology can potentially provide improved energy efficiently since it is an all-electrical operation and uses less energy than steam technologies.

However, known RF heating techniques are not well suited to the scenarios where the radiating element is separated from the RF power generator by a considerable distance, which may be due to the depth of the well, or where the well is horizontal and is 200 meters long or more. The long distance and limited diameter of the well, which in turn limits the available cross-section size of the transmission lines carrying the RF power to the radiating element, may lead to considerable loss of RF power before it reaches the radiating element. Further, the limited diameter of the well, and hence of the transmission lines, limits the available maximum RF power that can be transmitted down-hole. This makes it very difficult, if not impossible, to deliver to the radiating element a substantial amount of RF power, necessary for the extraction of the hydrocarbons using RF heating.

SUMMARY

In a first aspect, an apparatus for enhancing the extraction of hydrocarbons from an underground reservoir using a well is provided, in at least one embodiment, the apparatus may comprise a power source operable to supply periodic electrical power at a first frequency; at least one impulse generator unit operable to convert the periodic electrical power at the first frequency into periodic electrical power at a second frequency and to couple electromagnetic energy generated by the periodic electrical power at the second frequency into the reservoir, the second frequency being at least ten times higher than that of the first frequency; and a conducting cable being operatively coupled between the power source and the at least one impulse generator unit.

In at least one embodiment, the impulse generator unit comprises at least one frequency conversion unit operable to convert the periodic electrical power at the first frequency into periodic electrical power at the second frequency; and at least one energy coupling unit operable to couple electromagnetic energy generated by the periodic electrical power at the second frequency into the reservoir.

In at least one embodiment, the apparatus may also comprise a pipe; wherein at least one portion of the conducting cable is contained within the pipe; and at least one portion of the impulse generator unit is contained within the pipe.

In at least one embodiment, at least a portion of the power source may be located outside of the well and at least a portion of the pipe may be contained within the well.

In at least one embodiment, the first frequency may be between about 0 Hz and about 1000 Hz and the second frequency is between about 10 kHz and about 100 MHz.

In at least one embodiment, the pipe may comprise at least two pipe modules joined together to form the pipe; and each of the at least two pipe modules may comprise at least one impulse generator unit.

In at least one embodiment, the frequency conversion unit may comprise a switch operable to control the energy coupling unit; a driver circuit operable to drive state transitions of the switch; and a bypass capacitor.

In at least one embodiment, the apparatus may comprise at least one cladding material between the pipe and the at least one energy coupling unit.

In at least one embodiment, the return path for the conducting cable to the power source may be selected from the pipe, the first end of the pipe being operatively coupled to the power source and the second end of the pipe being operatively coupled to the conducting cable; the reservoir, the reservoir being operatively coupled to the conducting cable and the power source; and a secondary return cable, the secondary return cable being operatively coupled to the conducting cable and the reservoir.

In at least one embodiment, the apparatus may comprise a controller configured to adjust at least one operational parameter of the at least one impulse generator unit.

In at least one embodiment, the at least one operational parameter may comprise at least one of an enable parameter, a disable parameter, a phase, a phase delay, the second frequency, a power level, and a pulse shape.

In at least one embodiment, the apparatus may also comprise at least one sensor, operable to generate a sensor output data, the sensor output data being used to adjust the at least one operational parameter of the at least one impulse generator unit.

In at least one embodiment, the sensor output data may comprise at least one of a temperature, a pressure, a voltage, a current, a status, an impedance, permittivity, an electromagnetic field, a magnetic field and an electric field.

In at least one embodiment, the apparatus may also comprise a controller, operable to receive the sensor output data and to adjust the at least one operational parameter of the at least one impulse generator unit, based on the sensor output data.

In at least one embodiment, the apparatus may also comprise at least one communication unit associated with the at least one impulse generator unit, the at least one communication unit is configured to receive the sensor output data and to transmit the sensor output data to the controller.

In at least one embodiment, at least one communication unit may be operatively coupled to the conducting cable; and the controller may be operatively coupled to the conducting cable and may be operable to communicate with the at least one communication unit using the conducting cable.

In at least one embodiment, the apparatus may comprise at least two impulse generator units; and a controller operable to independently set at least one operational parameter of each of the at least two impulse generator units.

In a second aspect, there is a method for enhancing the extraction of hydrocarbons from an underground reservoir using a well. In at least one embodiment, the method may include supplying periodic electrical power at a first frequency to at least one impulse generator unit; converting the supplied periodic electrical power at the first frequency to a periodic electrical power at a second frequency, the second frequency being at least ten times higher that of the first frequency, using the at least one impulse generator unit; and coupling electromagnetic energy generated by the periodic electrical power at the second frequency into the reservoir, using the at least one impulse generator unit.

In at least one embodiment, the method may also include setting at least one operational parameter of the at least one impulse generator unit using a controller.

In at least one embodiment, at least one operational parameter may comprise at least one of an enable parameter, a disable parameter, a phase, a phase delay, the second frequency, a power level, and a pulse shape.

In at least one embodiment, the method may also comprise measuring a sensor data. In at least one embodiment, the method may also comprise setting at least one operational parameter of the at least one impulse generator unit based on the sensor data.

In at least one embodiment, the sensor data may comprise at least one of a resistance, a temperature, a pressure, a voltage, a current, a status, an impedance, an electric field, a magnetic field and an electromagnetic field.

In at least one embodiment, the method may also include transmitting sensor data from at least one sensor; receiving the sensor data; and setting the operational parameters of the at least one impulse generator unit based on the received sensor data.

In at least one embodiment, the method may also include measuring a sensor data, the sensor data comprising at least one of a resistance, a temperature, a pressure, a voltage, a current, a status, an impedance, an electric field, a magnetic field and an electromagnetic field; determining at least one of at least one complex dielectric property of the reservoir and at least one propagation property of the electromagnetic field in the reservoir, based on the measured sensor data; and adjusting at least one operational parameter of the at least one impulse generator unit based on the at least one of the at least one dielectric property of the reservoir and the at least one propagation property of the electromagnetic field in the reservoir.

In at least one embodiment, the method may also include independently setting at least one operational parameter of at least two impulse generator units.

In at least one embodiment, the method may also include independently setting at least one operational parameter of the at least two impulse generator units such that the electromagnetic energy generated by the periodic electrical power from the at least two impulse generator units is spatially synchronized.

In another aspect, an apparatus for enhancing the extraction of hydrocarbons from an underground reservoir using a well is provided. In at least one embodiment, the apparatus may include a power source operable to supply periodic electrical power; at least two impulse generator units operable to couple electromagnetic energy generated by the periodic electrical power at a radio frequency into the reservoir; and a conducting cable being operatively coupled between the power source and the at least one impulse generator unit.

In at least one embodiment, the apparatus may also include a controller operable to independently adjust at least one operational parameter of each of the at least two impulse generator units.

In at least one embodiment, the apparatus may also include at least one sensor, operable to generate a sensor output, the sensor output being used to independently adjust the at least one operational parameter of the at least two impulse generator units.

In at least one embodiment, the at least one operational parameter of each of the at least two impulse generator units is adjusted such that the electromagnetic energy generated by the periodic electrical power and coupled into the reservoir from the at least two impulse generator units is spatially synchronized.

In at least one embodiment, the at least one operational parameter comprises at least one of a power level, a phase and a phase delay of the periodic electrical power at the radio frequency.

In another aspect, there is a method for enhancing the extraction of hydrocarbons from an underground reservoir using a well. In at least one embodiment, the method may also include supplying periodic electrical power to at least two impulse generator units; coupling electromagnetic energy generated by the periodic electrical power at a radio frequency into the reservoir, using at least one impulse generator unit; independently adjusting at least one operational parameter of each of the at least two impulse generator units.

In at least one embodiment, the method may also include measuring a sensor data; independently adjusting the at least one operational parameter of each of the at least two impulse generator units based on the sensor data.

In at least one embodiment, the at least one operational parameter comprises at least one of a power level, phase and a phase delay of the periodic electrical power at the radio frequency.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
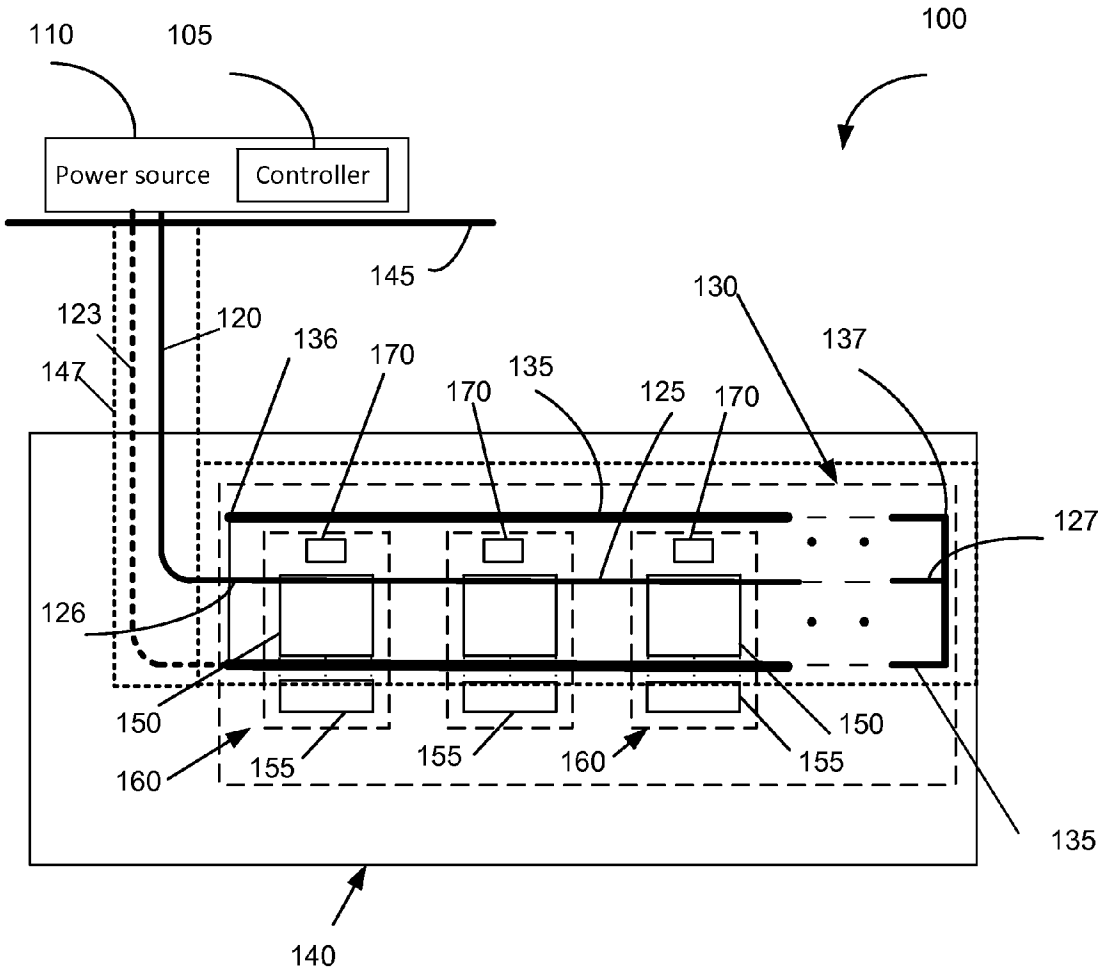
FIG. 1 is a schematic view of an apparatus for enhancing the extraction of hydrocarbons from an underground reservoir using a well, in accordance with at least one embodiment.

The skilled person in the art will understand that the drawings, described below, are for illustration purposes only. The drawings are not intended to limit the scope of the applicants teachings in anyway. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment", "embodiment", "embodiments", "the embodiment", "the embodiments", "one or more embodiments", "some embodiments", and "one embodiment" mean "one or more (but not all) embodiments of the present invention(s)", unless expressly specified otherwise.

The terms "including", "comprising" and variations thereof mean "including but not limited to", unless expressly specified otherwise. A listing of items does not imply that any or all of the items are mutually exclusive, unless expressly specified otherwise. The terms "a", "an" and "the" mean "one or more", unless expressly specified otherwise.

Further, although process steps, method steps, algorithms or the like may be described (in the disclosure and/or in the claims) in a sequential order, such processes, methods and algorithms may be configured to work in alternate orders. In other words, any sequence or order of steps that may be described does not necessarily indicate a requirement that the steps be performed in that order. The steps of processes described herein may be performed in any order that is practical. Further, some steps may be performed simultaneously.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

Furthermore, the recitation of any numerical ranges by end points herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made if the end result is not significantly changed.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

Furthermore, reference to radio frequency (RF) range is intended to mean frequencies between about 3 kHz and about 300 GHz.

FIG. 1 is a schematic illustration of apparatus 100 for enhancing the extraction of hydrocarbons from a reservoir 140, in accordance with at least one embodiment. For example, the reservoir 140 may contain crude oil or a geologic formation containing oil, heavy oil, bitumen or other hydrocarbons. The apparatus 100 includes a power source 110, at least one conducting cable 120, and a down-hole RF heater 130. The down-hole RF heater 130 includes at least one impulse generator unit 160.

In at least one embodiment, each impulse generator unit 160 may include at least one frequency conversion unit 150 and at least one energy coupling unit 155.

In at least one embodiment, the down-hole RF heater 130 may further include a pipe 135 and a delivery portion 125 of the conducting cable 120. For example, the delivery portion 125 of the conducting cable 120 may be substantially contained within the pipe 135.

In at least one embodiment, the down-hole RF heater 130 may be located inside the reservoir 140 below a ground surface 145. As shown in the example embodiment in FIG. 1, a well 147 may extend from the ground surface level 145 into the reservoir 140. For example, the well 147 may contain a well portion of the conducting cable 120.

In order to enhance the extraction of hydrocarbons from the reservoir 140 using the RF heating technique, the down-hole RF heater 130 of apparatus 100 radiates an electromagnetic field into the reservoir 140. The down-hole RF heater 130 is a device that sets up an electromagnetic field in the medium. In at least one embodiment, the down-hole RF heater 130 may operate as a distributed antenna. In at least one another embodiment, the down-hole RE heater 130 may operate as a lossy transmission line. The radiated electromagnetic field has a fundamental frequency within the radio-frequency range. For example, the fundamental frequency may be approximately about 10 kHz to about 100 MHz. The radiated signal at this fundamental frequency may be further modulated or may have a form of a train of pulses.

As it is shown in FIG. 1 the conducting cable 120 may carry the electrical energy from the above ground equipment 110 to the down-hole RF heater 130. Typically the electrical energy generated by the power source 110 is in the form of a waveform that is approximately sinusoidal and periodic, with a repetition rate denoted as a first frequency. This first frequency is not necessarily constant with time and may vary over a range of frequencies. Furthermore, this signal may deviate significantly from sinusoidal time dependence.

It should be borne in mind that at frequencies higher than 500 Hz, the electromagnetic field may magnetically couple to the pipe 135, resulting in excessive power losses. To prevent excess energy loss in the conducting cable, the first frequency may be low relative to the eventual radiated frequency (i.e. frequency of the energy radiated from the down-hole RF heater 130), in at least one embodiment.

In at least one non-limiting embodiment, the first frequency falls within a range from about 0 Hz to about 1000 Hz.

In at least one non-limiting embodiment, the first frequency may fall within a range from about 0 Hz to about 500 Hz. In at least one non-limiting embodiment, the first frequency may fall within a range from about 0 Hz to about 100 Hz. In at least one non-limiting embodiment, the first frequency may fall within a range from about 0 Hz to about 60 Hz. In at least one non-limiting embodiment, the first frequency may fall within a range from about 0 Hz to about 50 Hz. In at least one non-limiting embodiment, the first frequency may fall within a range from about 0 Hz to about 40 Hz. In at least one non-limiting embodiment, the first frequency may fall within a range from about 0 Hz to about 30 Hz. In at least one non-limiting embodiment, the first frequency may fall within a range from about 0 Hz to about 10 Hz.

In at least one non-limiting embodiment, the first frequency may fall within a range from about 30 Hz to about 1000 Hz. In at least one non-limiting embodiment, the first frequency may fall within a range from about 40 Hz to about 1000 Hz. In at least one non-limiting embodiment, the first frequency may fall within a range from about 50 Hz to about 1000 Hz. In at least one non-limiting embodiment, the first frequency may fail within a range from about 60 Hz to about 1000 Hz. In at least one non-limiting embodiment, the first frequency may fall within a range from about 70 Hz to about 1000 Hz. In at least one non-limiting embodiment, the first frequency may fall within a range from about 80 Hz to about 1000 Hz. In at least one non-limiting embodiment, the first frequency may fall within a range from about 100 Hz to about 1000 Hz. In at least one non-limiting embodiment, the first frequency may fall within a range from about 200 Hz to about 1000 Hz.

In at least one non-limiting embodiment, the first frequency may fall within a range from about 30 Hz to about 800 Hz. In at least one non-limiting embodiment, the first frequency may fall within a range from about 40 Hz to about 500 Hz. In at least one non-limiting embodiment, the first frequency may fall within a range from about 50 Hz to about 300 Hz. In at least one non-limiting embodiment, the first frequency may fall within a range from about 30 Hz to about 100 Hz.

In the down-hole RF heater 130, the electrical power signal at the first frequency is modulated such that the spectrum is shifted to a much higher frequency which will be referred to as the second frequency. The second frequency may be selected for efficient radiation from the down-hole RF heater 130.

In at least one embodiment, the second frequency signal emanating from the down-hole RF heater 130 may be approximately sinusoidal. The second frequency signal may also deviate significantly from the sinusoidal time dependence. For example, the second frequency signal may also be approximately periodic. As such the second frequency may vary with time.

Hence when referring herein to the first frequency signal and the second frequency signal as being periodic, it is implied that the repetition rates of the first frequency signal and the second frequency signal are approximately constant over short time epochs. It is also implied that the first frequency and the second frequency signals may vary with time in a deterministic or random fashion.

The second frequency may also be different at different impulse generator units 160 or at different groups of impulse generator units 160.

In at least one exemplary embodiment, the power source 110 supplies periodic electrical power having a periodic waveform at a low first frequency. This electrical power is delivered via the conducting cable 120 to the underground down-hole RF heater 130.

Further, the down-hole RF heater 130 receives the periodic electrical power at the first frequency and converts (modulates) the received periodic electrical power to a significantly higher second frequency. The periodic electrical power at this significantly higher second frequency then generates an electromagnetic field that is radiated into the reservoir 140 in order to enhance the extraction of hydrocarbons from the reservoir 140. This process may be also described as "coupling of the electromagnetic energy generated by the periodic electrical power into the reservoir 140".

In at least one non-limiting embodiment, the second frequency may be radio frequency. In at least one non-limiting embodiment, the second frequency falls within a range from about 10 kHz to about 100 MHz. In at least one non-limiting embodiment, the second frequency may fall within a range from about 30 kHz to about 50 MHz. In at least one non-limiting embodiment, the second frequency may fall within a range from about 50 kHz to about 10 MHz. In at least one non-limiting embodiment, the second frequency may fall within a range from about 100 kHz to about 10 MHz.

The second frequency of the radiated energy may further be optimized in order to provide a higher amount of heat at a particular distance from the RF heater 130 (e.g. several meters to tens of meters where heat is desired), and to provide a lower amount of heat produced in close proximity to the RF heater 130 (where heat is undesirable), or otherwise engineered to deliver required heating pattern within the reservoir.

In at least one embodiment, the power source 110 may be any constant current power source capable of supplying periodic electrical power of approximately several kilowatts (kW) to several megawatts (MW) and where the supplied electromagnetic field waveform is modulated at a first frequency. For example, the power source 110 may supply a current which may fall within the range of about 10 Amperes (A) to about 1000 A. For example, the power source 110 may supply a voltage which may fall within the range of about 100 Volts to about 20 kilovolts (kV). For example, for the apparatus 100 where the pipe 135 has a length that is typically more than 200 m, the power source 110 may supply a current of approximately 300 A and a voltage of approximately several kV.

In at least one embodiment, the power source 110 may be located at least partially above the ground surface level 145 and at least partially outside of the well 147.

In at least one embodiment, the conducting cable 120 conducts current from the power source 110 to the downhole RF heater 130. It should be understood that the conducting cable 120 may be made of any material suited for transmission of electrical power signal. For example, the conducting cable 120 may be made of copper, aluminium, or any highly conductive metal of low electrical conduction losses. For example, the conducting cable 120 may also be made of a standard underground power cable.

Referring still to FIG. 1, the pipe 135 has a first end 136 and a second end 137. The first end 136 is downstream from the power source 110 and the second end 137 is downstream from the first end 136.

A portion of the conducting cable 120, which is located between the first end 136 of the pipe 135 and the second end 137 of the pipe 135, is referred herein to as a hot delivery cable 125. The hot delivery cable 125 may be substantially located inside the pipe 135 and may deliver current to at least one impulse generator unit 160.

In at least one embodiment, the pipe 135 may be used as a return path for the delivery cable 120 to the source 110. In this example embodiment, the delivery cable 125 may enter the pipe 135 at the first end 136 of the pipe 135 and the delivery cable 125 may be shorted to a casing of the pipe 135 at the second end 137 of the pipe 135. In this example embodiment, the pipe 135 may be operatively coupled to the power source 110 via a return cable 123.

In another embodiment, the surroundings of the pipe 135, or reservoir 140, may be used as a return path for the delivery cable 120 to the power source 110. In this example, the power source 110 may be operatively coupled to conducting cable 120 and to the reservoir 140. The delivery cable 125 may be then operatively coupled to the conducting cable 120 and to the reservoir 140. Thus the reservoir 140 may become coupled to the conducting cable and the power source 110.

In another embodiment, a secondary cable (not shown in FIG. 1) may provide the return path for the conducting cable 120 to the power source 110. In this example embodiment, the power source 110 may be first operatively coupled to a first end of the conducting cable 120. The second end of the conducting cable 120 then may be operatively coupled to the first end of the secondary return cable. The second end of the secondary return cable may then be coupled to the power source 110.

The pipe 135 may be made of any conducting material, for example, steel. One of the advantages of the invention is that the pipe 135 may be any standard pipe used in oil and gas industry. For example, a diameter of the pipe 135 may be between 3 and 9 inches or more. Wider or narrower diameters may be used, depending on the specifics of the oil well and oil formation and other factors such as economics.

The length of the pipe 135 and the length of the hot delivery cable 125 may be approximately the same and may be as long as the length of the formation reservoir 140. For example, the length of the pipe 135 may be approximately 100 to 2000 meters long.

In at least one embodiment, the pipe 135 may be built of contiguous sections.

In at least one embodiment, additional tubes may be contained in the pipe 135. For example, the tubes may carry water or gas or solvents required by the process. In particular, liquids or pressurized gases might be used for cooling purposes, or as additional driving medium for hydrocarbon production.

In at least one embodiment, at least one impulse generator unit 160 is located partially inside the pipe 135. For example, at least one portion of the frequency conversion unit 150 may be located inside the pipe 135 and at least one portion of the energy coupling unit 155 may be located outside of the pipe 135. In at least one embodiment, at least two impulse generator units 160 are located along the pipe 135.

For example, if the length of the pipe 135 is approximately 1000 meters, there may be 4000 impulse generator units 160 (for example, one every 25 cm), distributed along the pipe 135 or more. The actual number of impulse generator units 160 depends on the specific formation and heating requirements, as well as the specifics and power output of impulse generator units 160. The power output and other characteristics of the impulse generator units 160 may vary in different implementations, for example, depending on the specific transistor or other active elements used.

Referring still to FIG. 1, in at least one embodiment, the frequency conversion unit 150 may be configured to receive periodic electrical power having a periodic waveform at a first frequency. As discussed above, the first frequency may be relatively low and for example may fall in the range of about 0 Hz and about 1000 Hz.

The frequency conversion unit 150 may then convert the periodic electrical power having a first frequency to periodic electrical power having a second frequency. In at least one embodiment, the second frequency may be at least 10 times that of the first frequency.

In at least one embodiment, the second frequency is radio frequency (RF). For example, the second frequency may fall in the range of about 10 kHz and about 100 MHz.

The frequency conversion unit 150 may transmit periodic electrical power having a periodic waveform at the second frequency to the energy coupling unit 155. The energy coupling unit 155 may then couple electromagnetic energy into the formation reservoir 140.

For example, the energy coupling unit 155 may be a strip, a wire, a strip or wire circuit, a section of a pipe, a coil or coil winding placed on the outside of the pipe and connected to impulse generator unit 160. For example, coil winding may be made of highly conductive wire such as copper or aluminum wound on a dielectric form.

In at least one embodiment, the apparatus 100 may also include a controller 105. For example, the controller 105 may be operably connected to the power source 110. The controller 105 may be configured to determine at least one operational parameter of the at least one impulse generator unit 160. The controller 105 may further send this at least one operational parameter to the at least one impulse generator unit 160.

Further, if the apparatus 100 comprises at least two impulse generator units 160, the controller 105 may be configured to independently determine, set, or adjust the operational parameters of each of the impulse generator units 160. For example, the operational parameters may comprise at least one of an enable parameter, a disable parameter, a phase, a phase delay, a frequency (for example, the second frequency), a power level, and a pulse shape.

In at least one embodiment, an impulse generator unit 160 may contain at least one communication/controller unit 170. For example, the communication/controller unit 170 may receive the operational parameters from the controller 105. The communication/controller unit 170 may also control the operation of the other components of the impulse generator unit 160. For example, the communication/controller unit 170 may control the operation of the other components of the impulse generator unit 160 independently from the controller 105. For example, the communication/controller unit 170 may control the operation of the frequency conversion unit 150 and/or the energy coupling unit 155.

The communication/controller unit 170 may also be either a communication unit or a controller unit or both. For example, the communication/controller unit 170 may operate independently from the controller 105.

In at least one embodiment, one communication/controller unit 170 may receive the operational parameters from the controller 105 and/or control the operation of two or more impulse generator units 160.

Figure 2:
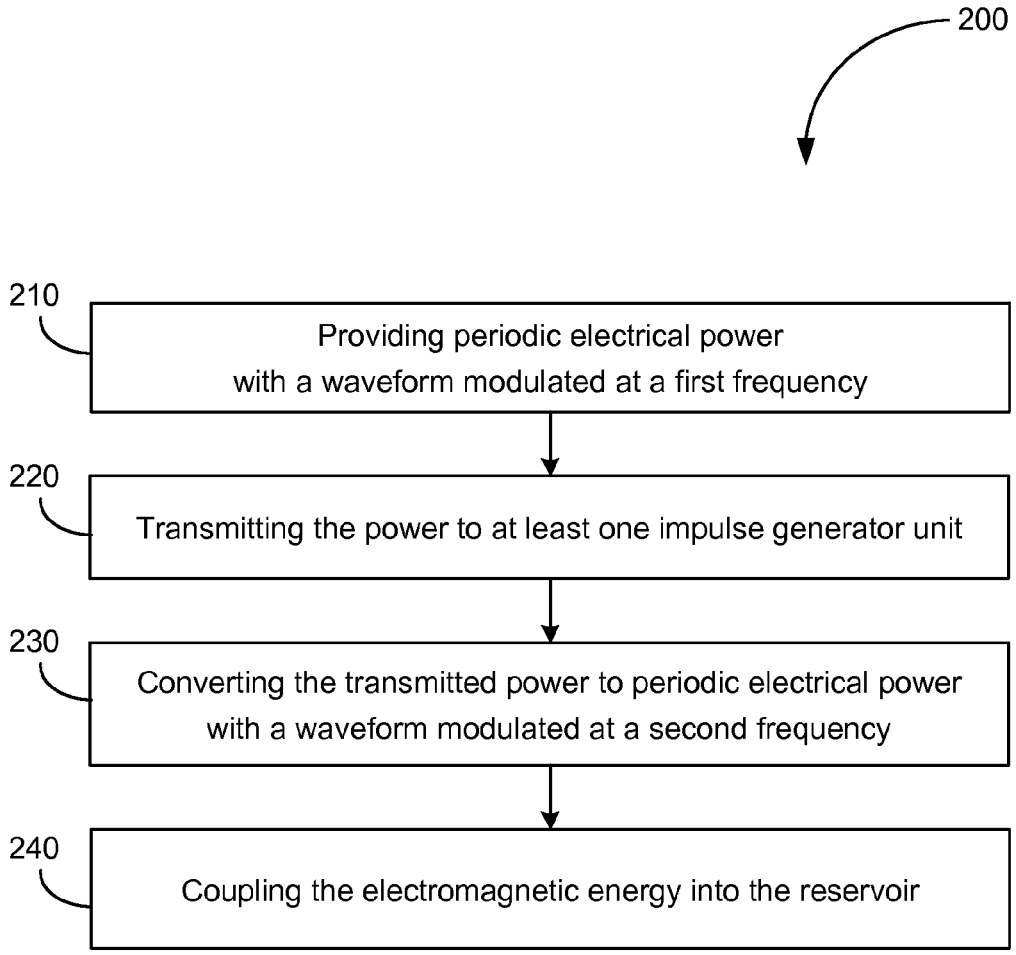
FIG. 2 is a flowchart illustrating a method for enhancing the extraction of hydrocarbons from the underground reservoir, in accordance with at least one embodiment.

Referring now to FIG. 2, shown therein is a flowchart of an example embodiment of the method 200 for enhancing the extraction of hydrocarbons from an underground reservoir. At 210, periodic electrical power is provided having a periodic waveform at a first frequency. The current or power may be generated above the ground surface level 145. The periodic electrical power could either be a direct current (DC) or a low frequency alternating current (AC).

In at least one embodiment, the generated periodic electrical power is characterised by a low-frequency periodic signal at the first frequency. For example, the current may be delivered to the power source 110 via high-voltage transmission lines or generated/reformed locally on the surface.

At 220, the periodic electrical power signal at the first frequency is conducted to at least one frequency conversion unit 150. For example, practical electrical power generation from a diesel generator may result in a sinusoidal waveform. In another example, the periodic electrical power signal at the first frequency may also be sourced from power invertors, such that the waveform shape can deviate significantly from sinusoidal.

At 230, the supplied periodic electrical power having a waveform modulated at the first frequency is converted to periodic electrical power having a waveform modulated at a second frequency. In at least one embodiment, the conversion may be performed by modulation (for example, on/off) of the delivered power at the second frequency.

In at least one embodiment, the second frequency is at least ten times that of the first frequency. In at least one embodiment, the second frequency is a radio-frequency signal having spectral power content in the range from about 10 kHz to about 100 MHz.

At 240, the electromagnetic energy, generated by the periodic electrical power with the waveform modulated at the second frequency, is coupled into the reservoir 140. In at least one embodiment, the electromagnetic energy is radiated from at least one energy coupling unit 155 into the reservoir 140.

Figure 3:
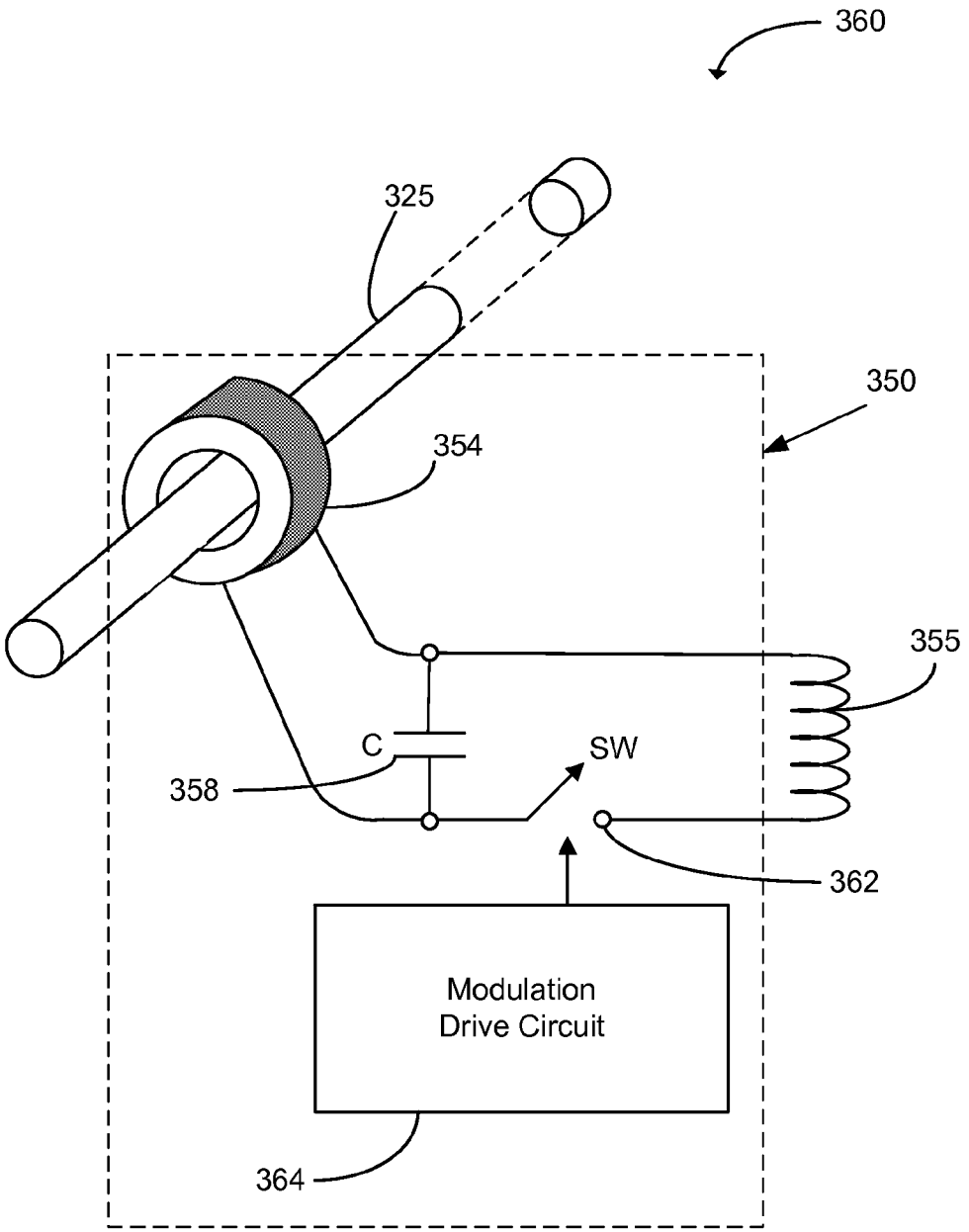
FIG. 3 is a schematic view of an impulse generator unit, in accordance with at least one embodiment.

Referring now to FIG. 3, a schematic of an example embodiment of an impulse generator unit 360 is illustrated which includes a frequency conversion unit 350 and an energy coupling unit 355, in accordance with at least one embodiment. This frequency conversion unit 350 comprises a toroidal transformer 354, a capacitance 358, a switch 362, and a switching/modulation driver circuit 364. The energy coupling unit 355 is implemented by a coil 355, positioned at least partially outside the pipe 135 (shown in FIG. 1).

In the example embodiment, the periodic electrical power, discussed above, is delivered to a portion of the delivery cable 325.

In at least one embodiment, the power delivered via the delivery cable may be AC power. In at least one embodiment, the waveform of the power delivered may be sinusoidal. In another embodiment, the power waveform may have any periodic form other than sinusoidal. As discussed above, the power waveform may be modulated at the first frequency.

In at least one embodiment, a toroidal transformer 354 may be coupled to or may surround the portion 325 of the delivery cable 125. The toroidal transformer 354 couples the periodic electrical power to an electrical circuit, which contains a coil 355, a switch 362, and a capacitor 358. A person skilled in the art will appreciate that the toroidal transformer 354 is capable to couple the periodic electrical power to the load from the delivery cable portion 325. The Thévenin's equivalent source voltage and impedance are functions of the current passing through the delivery cable portion 325 and the parameters of the coupling toroid 354. In at least one embodiment, the parameters of toroids 354 may be identical or almost identical.

In at least one embodiment, the current delivered to the cable delivery portion 325 does not vary with the location of the toroidal transformers 354 along the delivery cable 125 on FIG. 1. Moreover, the current delivered to different portions of the delivery cable 125 may be approximately the same. For example, the current delivered to an end portion 126 (FIG. 1) may be approximately the same as the current delivered to an end portion 127 (FIG. 1). Therefore, the toroidal transformers 354, located at different positions along the delivery cable 125, may receive approximately the same amount of current, or may have the same amount of power available to them, and therefore the same AC power may be coupled to each frequency modulation unit 150.

Referring again to FIG. 3, in at least one embodiment, the capacitor 358 may provide an RF bypass. The capacitor 358 does not need to have a significant capacitance because the AC frequency is typically around several 100 Hz or less. However, without the capacitor 358, the current would couple back into the AC line and the high inductance of the power coupling toroid 354 would limit the rate of current rise through the radiating coil 355.

In at least one embodiment, each impulse generator unit 360 may have a rectifier to convert AC power to DC power.

In at least one embodiment, the switch SW 362 may be driven at the second frequency by a signal from the modulation drive circuit 364. In at least one embodiment the signal can have approximately a form of a square wave. In at least one exemplary embodiment, the second frequency may be in the RF range. For efficiency, it is important for the modulation of the switch SW 362 to be sufficient to turn the switch completely on or off with minimal transition time.

As soon as the current rise slows down, the switch SW 362 should be opened again. This collapses the current through the coil 355 and generates an electromagnetic wave pulse.

In at least one embodiment, the switch 362 may be a high power switching device which facilitates the AC to RF conversion. For example, the switch 362 may be a high power semiconductor switch. For example, the switch may be a metal-oxide-semiconductor field-effect transistor (MOSFET) or a bipolar junction transistor, or other semiconductor device.

When the switch closes, current in the coil 355 builds up at a rate proportional to the instantaneous AC voltage. The AC power from the AC delivery cable is converted to a high frequency modulation current at the coil 355.

Figure 4A:
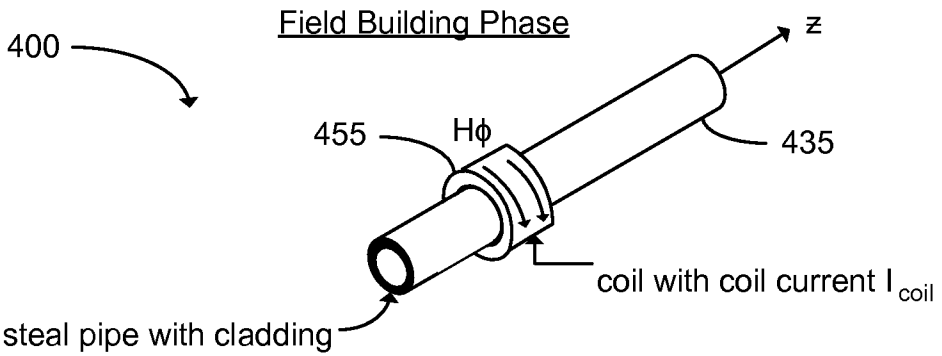
FIG. 4A is an illustration of a toroidal coil in a field building phase, in accordance with at least one embodiment.
Figure 4C:
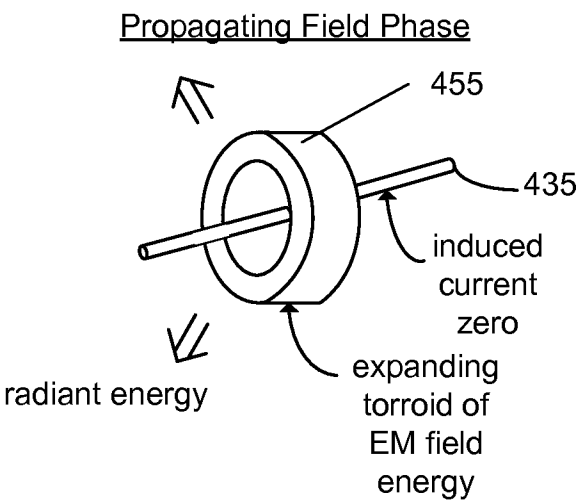
FIG. 4C is an illustration of a toroidal coil in a propagating field phase, in accordance with at least one embodiment.
Figure 4B:
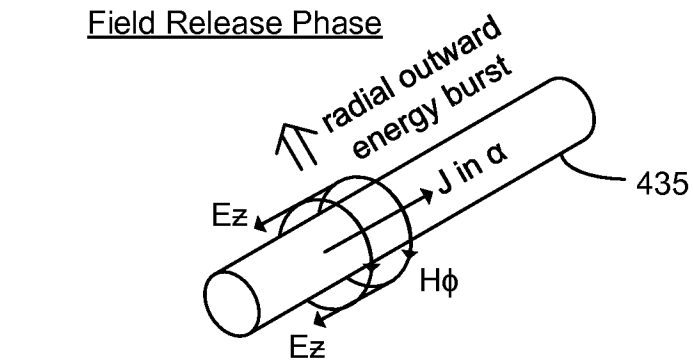
FIG. 4B is an illustration of a toroidal coil in a field release phase, in accordance with at least one embodiment.

The radiation mechanism of the coil 355 may comprise three phases, explained in FIGS. 4A, 4B, and 4C.

Referring now to FIG. 4A, illustrated therein is a toroidal coil 455 in a field building phase, according to at least one embodiment. The coil 455 begirds or encircles a portion of the steel pipe 435. At the field building phase, coil current $I_{coil}$ generates a magnetic field $H_{\varphi}$, which encircles the pipe 435. During this phase, the pipe's induced current is 0. The total stored field energy of the coil at the end of this phase is $$E = \frac{1}{2} L_{coil} I_{coil}^2,$$

where $L_{coil}$ is the inductance of the coil 455.

Referring now to FIG. 4B, illustrated therein is the toroidal coil 455 in a field release phase, according to at least one embodiment. At the field release phase, the coil current quickly decreases to zero, which makes the coil almost transparent to magnetic fields. The collapsing magnetic field sets up two events. First, a brief burst of induced current, denoted as $J_{ind}$, flows in the outside cladding region of the pipe along the z axis. Second, a portion of the magnetic field gives rise to an electric field and the combined EM field results in an outgoing radiation burst.

Referring now to FIG. 4C, illustrated therein is the toroidal coil 455 in a propagating field phase, according to at least one embodiment. At the propagating field phase, the emanating EM field propagates outward like an expanding toroid of a short energy burst. The electric field contained in the expanding toroidal volume interacts with the medium resulting in dissipation that is converted into heat.

The parameters and the operating conditions of the switch 362 may be estimated approximately from the desired energy to be coupled to the reservoir 140 and the cycle of the energy coupling phases.

For example, if the cycle of three energy coupling phases described above is repeated every 100 nanoseconds or $10^7$ Hz, in order to couple the energy of 200 W (which corresponds to 200 Joules per second) to the reservoir 140, the coil energy after each build up phase should be: 200 W/$10^7$ Hz=20 μJ. This means that each emanating burst may generate 20 μJ. If the inductance of the coil 355 is $L_{coil}$=0.5 μH, the estimate of the coil current from the equation $$E = \frac{1}{2} L_{coil} I_{coil}^2$$

gives 13 A. To achieve this reasonable current, the switch input voltage should be approximately 30 V, if estimated using the equation $$V_{coil} = L_{coil} \frac{dI_{coil}}{dt}.$$

Figure 5A:
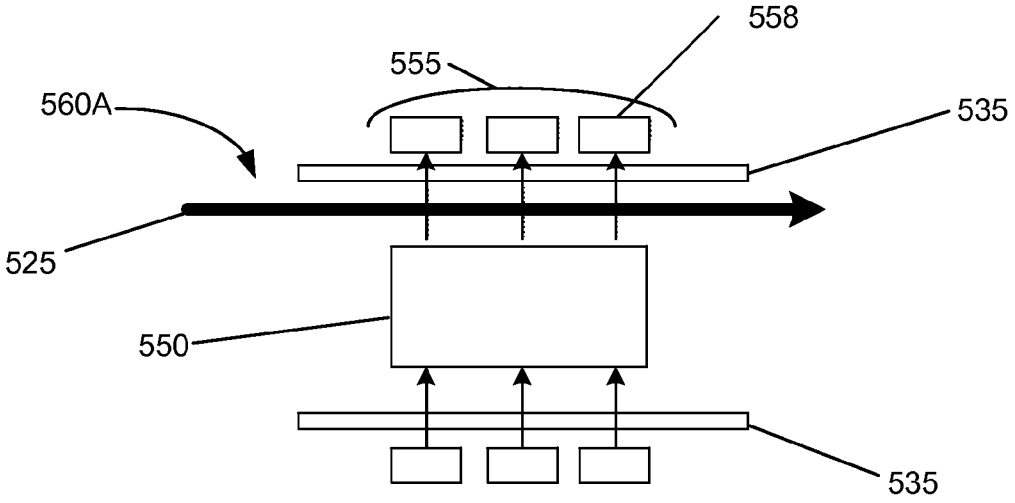
FIG. 5A is a schematic view of an impulse generator unit, in accordance with at least one embodiment.

Referring now to FIG. 5A, shown therein is a schematic view of an impulse generator unit 560A, according to at least one embodiment. In this example, a coil subset unit 555 is powered by a frequency conversion unit 550. A coil subset unit 555 may comprise more than one coil 558.

Figure 5B:
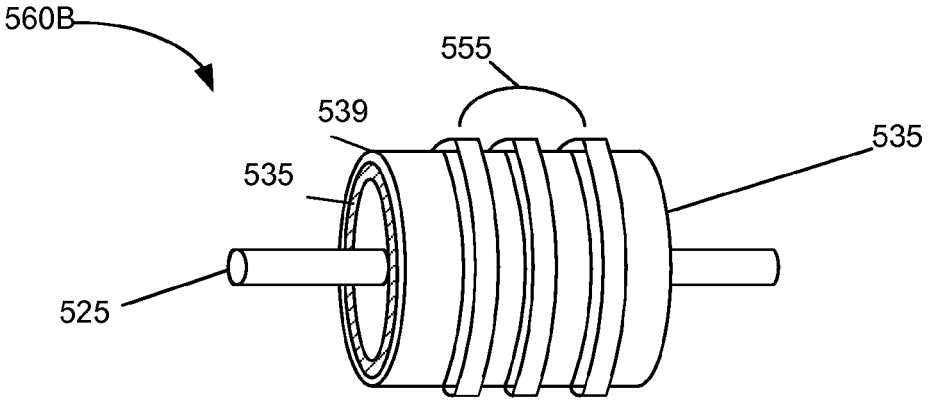
FIG. 5B is a schematic view of one segment of an impulse generator unit, in accordance with at least one embodiment.

Referring now to FIG. 5B, shown therein is a schematic view of one segment of an impulse generator unit 560B, according to at least one embodiment.

In at least one embodiment, the pipe 535 may be covered by cladding 539 and form a layer between the pipe 535 and the coils 555. For example, a cladding may be a thin sheet made of a highly conductive material, which has very low magnetic permeability. For example, the cladding may be made of copper or aluminum. The cladding may also be a foil type wrapping that is easily applied in the pipe fabrication process or a tube/pipe otherwise fixed on the pipe 535. The cladding allows for efficient propagation of the EM energy away from the pipe. Therefore, the cladding may help to increase the ratio of desired heat to undesired heat.

The cladding 539 may also include a dielectric material and a ceramic material.

Figure 5C:
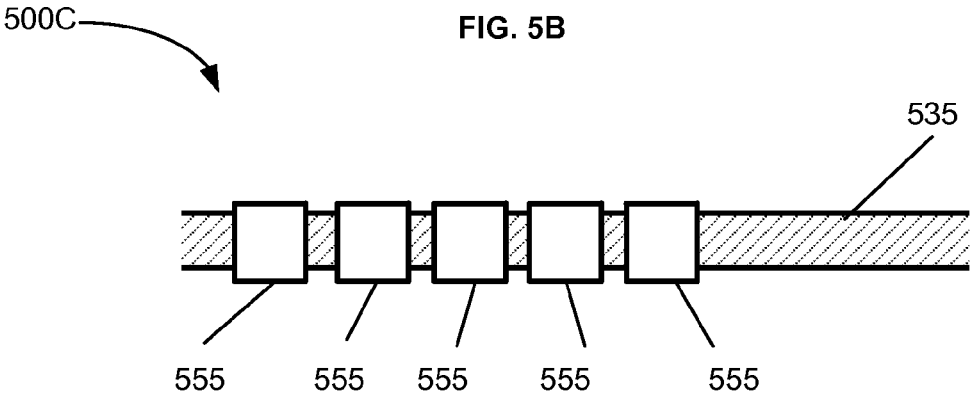
FIG. 5C is a schematic view of the coil subset units, mounted on the pipe, in accordance with at least one embodiment.

Referring now to FIG. 5C, shown therein is a schematic view of the coil subset units 555, mounted on the pipe 535, according to at least one embodiment.

In at least one embodiment, conversion of periodic electrical power at the first frequency to periodic electrical power at the second frequency is distributed along the pipe. For example, an array or a plurality of the frequency conversion units 150 may be located along the pipe 135. In at least one embodiment, the frequency conversion units 150 are separated by approximately equal distance.

With a plurality of the impulse generator units along the pipe, there will be a plurality of points of conversion of electrical power at the first frequency to RF power, which is modulated at the second frequency. As the active AC to RF conversion relies on vulnerable electronics, such a configuration allows for the avoidance of a single point of failure within the apparatus.

The density of the impulse generator units 160 along the length of the pipe 135 may be adjusted depending on the requirements and environmental conditions. In one of the embodiments, each frequency conversion unit 150 may draw approximately 200 W from the AC source. For example, approximately 10,000 energy coupling units may be required over the pipe length of about one to two kilometers, resulting in a total power draw of approximately 2 MW from the power source 110.

Figure 6A:
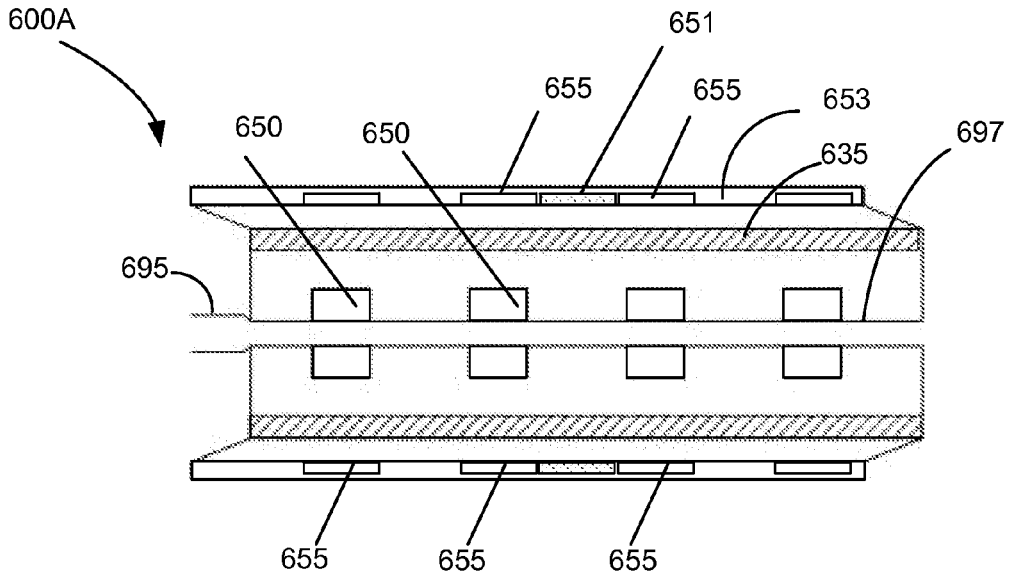
FIG. 6A is a schematic view of a module, in accordance with at least one embodiment.

Referring now to FIG. 6A, shown therein is a cross-section of an exemplary embodiment of a module 600A which may be assembled with other modules to form a complete pipe 135 assembly. A pipe portion 635, conducting cable 625, frequency conversion units 650, energy coupling units 655, and the cladding 639 have been previously described. The module 600A may contain at least one frequency conversion unit 650 and at least one energy coupling unit 665.

Figure 6B:
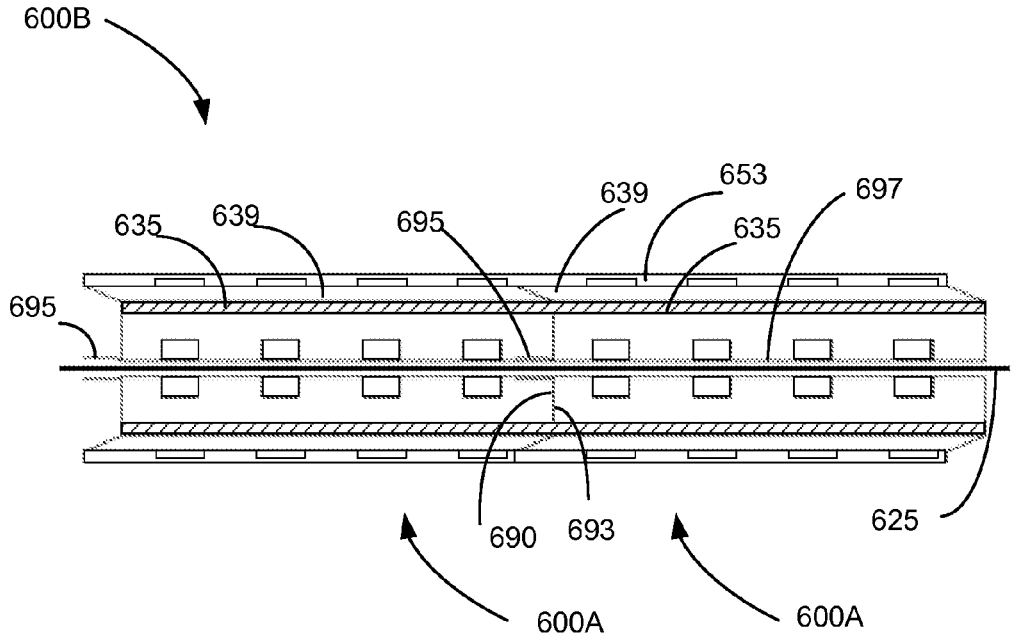
FIG. 6B is a schematic view of an assembly of two stackable modules, in accordance with at least one embodiment.

In at least some embodiments, the apparatus 100 may comprise a plurality of stackable modules 600A, as shown in FIG. 6B. For example, connectors 695 may connect the modules to each other. In at least one embodiment, the connectors may be blind mate connectors.

For example, the length of one module 600A may be approximately 10 meters.

While the apparatus 100 may be built over a contiguous pipe and such that construction may be mechanically robust, the coils 655 are vulnerable during the installation phase. Therefore, in at least one embodiment, dielectric fillers or spacers 651 may be used between the coils 655. In at least one embodiment, a sacrificial dielectric layer 653 may coat the entire cladding with coils 655. This dielectric layer 653 then may be scraped off when the apparatus is installed down-hole or it may be destroyed during the heating process.

The side portions 690 and 693 of the modules 600A may have various configurations. For example, the side portions 690 and 693 of the modules 600A may be adapted to ease connection between the modules. For example, the side portions 690 and 693 of the modules 600A may have larger diameter than the central portion of the modules 600A. In at least one embodiment, the pipe 635 may have slightly smaller diameter in between the side portions 690 and 693 of the modules 600A, thus creating a space to safely place coils 655, spacers 651, and sacrificial dielectric layers 653.

Constructing a pipe 135 from stackable modules 600A has numerous advantages. Modules 600A may be cost effective to manufacture, install, operate and eventually dismantle. In at least one embodiment, the modules 600A are identical and may be easily manufactured. For example, if one of the units fails, only the module that contains the failed unit needs to be replaced. This may provide easy and cost-effective repairs of the assembly.

In at least one embodiment, any number of modules 600A may be coupled and connected to form a pipe 135. Therefore, pipes 135 of any length may be built.

In at least one embodiment, the modules may have at least one conduit 697. For example, the conduit 697 may be a nonconductive pipe that is housed inside the module 600. The conduit 697 may be designed and/or constructed in such a way that, upon connection of several modules, it creates a non-conductive conduit extending through all modules. For example, the frequency conversion units 650 and other hardware may be mounted on the conduit 697. This may facilitate fabrication of the module 600.

For example, once all the modules are deployed, the conduit 697 may facilitate insertion of the hot cable 625, which may be fed through the conduit 697. In another embodiment, cable 125 may be pre-inserted into the modules and connection may be established at module interfaces to form the conducting power cable 125.

Generally, a formation layer with the crude oil may have around a few to a few hundred meters in height. The length and the width of the reservoir with the crude oil may stretch for several kilometers.

Figure 7A:
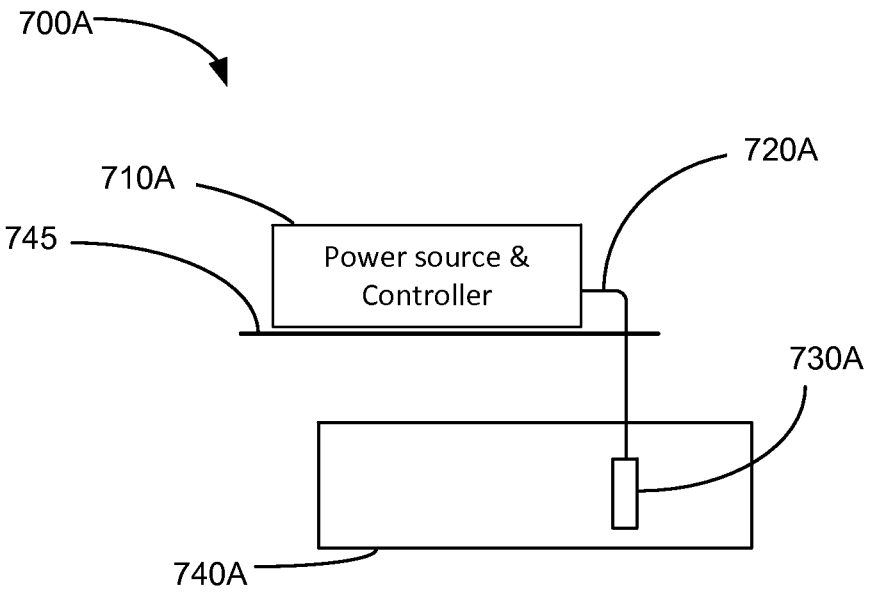
FIG. 7A is a schematic view of a vertical well apparatus for enhancing the extraction of hydrocarbons from an underground reservoir using a well, in accordance with at least one embodiment.

FIG. 7A illustrates a vertical well apparatus 700A for enhancing the extraction of hydrocarbons, according to one of the embodiments. In this apparatus, a down-hole RF heater 730A is located inside a reservoir 740A and is oriented vertically. The vertical RF heater 730A does not need to be longer (higher) than the height of the reservoir 740A. For example, the length of the RF heater 730A may be approximately 200 meters. However, to efficiently extract hydrocarbons from the wide and long reservoir 740A, more than one vertical well apparatuses 700A should be built.

Figure 7B:
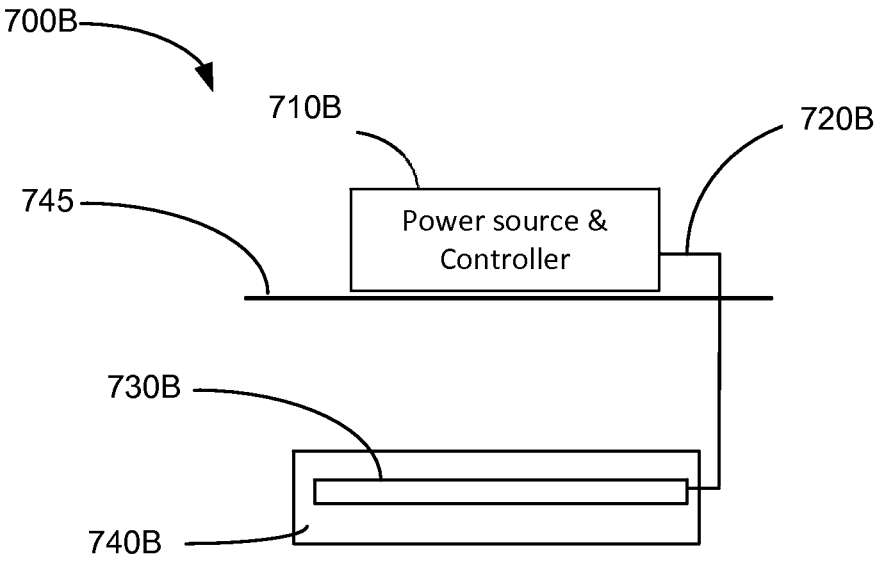
FIG. 7B is a schematic view of a horizontal well apparatus for enhancing the extraction of hydrocarbons from an underground reservoir using a well, in accordance with at least one embodiment.

FIG. 7B illustrates a horizontal well apparatus 700B for enhancing the extraction of hydrocarbons, according to one of the embodiments. In this exemplary embodiment, the down-hole RF heater 730B is located horizontally inside the reservoir 740B.

Using modules 600A to construct the heaters 730A and 740B, the length of the heaters 730A and 740B may be adjusted to the length or the height of the formation reservoirs 740A or 740B. Therefore, by adjusting the number of modules 600A and their operational parameters, both horizontal and vertical assemblies may be built using the same modules 600A.

In at least one embodiment, sensors may be placed inside and/or outside of the pipe 135 to monitor various environmental aspects. For example, the apparatus 100 may include at least one sensor to detect and/or measure a sensor data. The sensor data may comprise at least one of a temperature, a pressure, a voltage, a current, a status, impedance, a resistance, permittivity, an electromagnetic field, a magnetic field and an electric field. In at least one embodiment, at least one sensor may be at least one of a temperature sensor, a pressure sensor, and a status sensor. In at least one embodiment, at least one sensor may detect and measure a voltage or a current, related to the energy coupling unit 155.

In at least one embodiment, the apparatus 100 may record and/or process the sensor data. In at least one embodiment, the output sensor data may be used to set and/or adjust the operational parameters of the at least one impulse generator unit 160. For example, one may want to enable or disable one particular impulse generator unit or an array of impulse generator units. For example, a phase, a phase delay, a frequency (for example, the second frequency), a power level, and a pulse shape of the power may be adjusted based on the received data from the sensors.

Those skilled in the art will understand that for harmonic (sinusoidal) signals the terms phase delay and time delay are equivalent. When the signal is a periodic train of pulses and, hence, in the spectral domain, is represented by a fundamental harmonic component (with frequency equal to that of the periodic frequency) and many higher order harmonics, the term "phase delay" becomes less precisely defined. In the context of this application, for a train of periodic pulses at the second frequency, the phase delay shall describe the phase delay of the fundamental harmonic (at the second frequency). This phase delay is equivalent to the time delay introduced to the train of pulses.

The output sensor data may be then transmitted to a controller 105. The controller 105 may be configured to determine at least one operational parameter of at least one impulse generator unit based on the sensor output data. The controller 105 may then send the at least one operational parameter to the at least one impulse generator unit. For example, the at least one operational parameter may comprise at least one of an enable parameter, a disable parameter, a phase, a phase delay, a frequency (for example, the second frequency), a power level, and a pulse shape.

For example, if the apparatus 100 comprises at least two impulse generator units 160, the controller 105 may independently adjust the operational parameters of each of the impulse generator units 160 based on the sensor data received from the sensors.

In at least one embodiment, the sensor associated with one impulse generator unit 160 may be able to measure the electromagnetic field. For example, the electromagnetic field may be generated by the same impulse generator unit 160, by another impulse generator unit, by impulse generator units within the same module, or by any other array of the impulse generator units.

Figure 8:
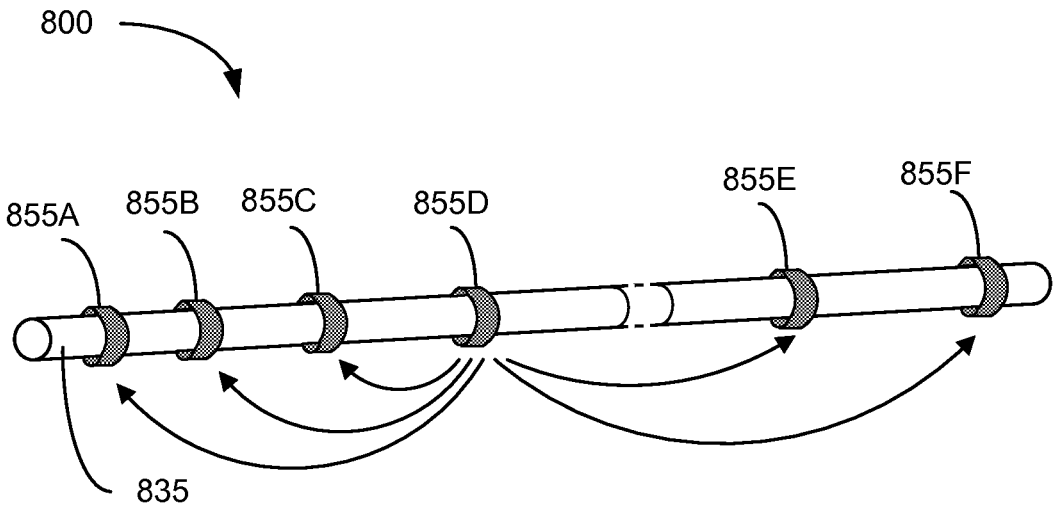
FIG. 8 is a schematic view of a pipe and coils, in accordance with at least one embodiment.

Referring now to FIG. 8, wherein illustrated are energy coupling units 855A, 855B, 855C, 855D, 855E, 855F, and a pipe 835, according to at least one embodiment. In this example embodiment, the energy coupling unit 855D radiates the EM field into the reservoir 140 and the other energy coupling units 855A, 855B, 855C, 855E, and 855F are listening and measuring the EM field.

For example, there may be n energy coupling units 855. In this example embodiment, the energy coupling unit 855F may be the n-th energy coupling unit. For example, when the energy coupling unit 855D radiates the EM field into the reservoir 140, the other (n−1) energy coupling units may measure the EM field.

In at least one embodiment, the apparatus 100 may record and/or process the EM field data. Based on the measured radiated and received EM field, the coupling between the energy coupling units 855 may be determined. For example, the coupling of the energy between the energy coupling units 855 may be a function of dielectric parameters of the medium. For example, these measurements may provide the data for the tomographic computation of the medium dielectric properties along z.

For example, the electromagnetic propagation constant in the reservoir 140 and/or any other dielectric property of the reservoir 140 may be estimated and/or determined based on the sensor data. For example, complex dielectric property of the reservoir 140 may be estimated and/or determined. For example, conductivity property of the reservoir 140 may be estimated and/or determined. For example, at least one propagation property of the electromagnetic field in the reservoir 140 may be estimated and/or determined based on the sensor data. For example, the electromagnetic propagation constant in the reservoir 140 and/or any other dielectric property of the reservoir 140 may be determined based on the measured transmitted and received EM field. At least one operational parameter of the at least one impulse generator unit 160 may be adjusted based on the determined dielectric property of the reservoir 140 and/or the propagation property of the electromagnetic field in the reservoir 140.

In at least one embodiment, the dielectric properties of the medium or phase velocity of electromagnetic waves in the medium may be estimated by measurements made at the location close to one impulse generator unit, while another impulse generator unit radiates. These measurements may further provide information regarding the health of the coil 155 and the impulse generator unit 160.

The measurement of the energy coupling may be very short, requiring only several seconds to complete. In at least one embodiment, sets of coils may radiate simultaneously, which may speed up the monitoring process. For example, such tomography algorithm can be run every few hours of operation of the apparatus in order to update the reservoir model and track changes.

In at least one embodiment, the tomography algorithm may be used along with the apparatus temperature measurements and surface seismic analysis.

Figure 9:
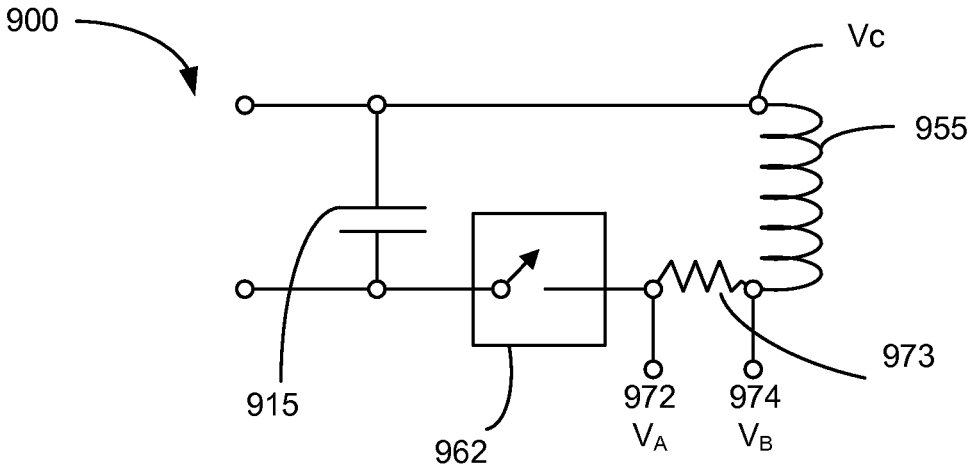
FIG. 9 is a schematic view of an impulse generator unit with a sensor, in accordance with at least one embodiment.

Referring now to FIG. 9, shown therein is an impulse generator unit 900 with a coil sensor, according to at least one embodiment. A capacitor 915, a coil 955, and a switch 962 have been previously described. In at least one embodiment, a small series resistor 973 is located between the coil 955 and the switch 962 to measure voltage $V_A$-$V_B$. In this example, the resistor 973 determines the coil current, when the switch 962 is closed during the field building phase.

In at least one embodiment, measurement of the voltage $V_C$-$V_B$, when the switch 962 is opened, provides the open circuit voltage. In this example, the radiated energy from the coil can be estimated during the field building phase.

In at least one embodiment, the open circuit voltage measurement can be used to determine the magnetic field that propagates from one coil to the next.

Figure 10:
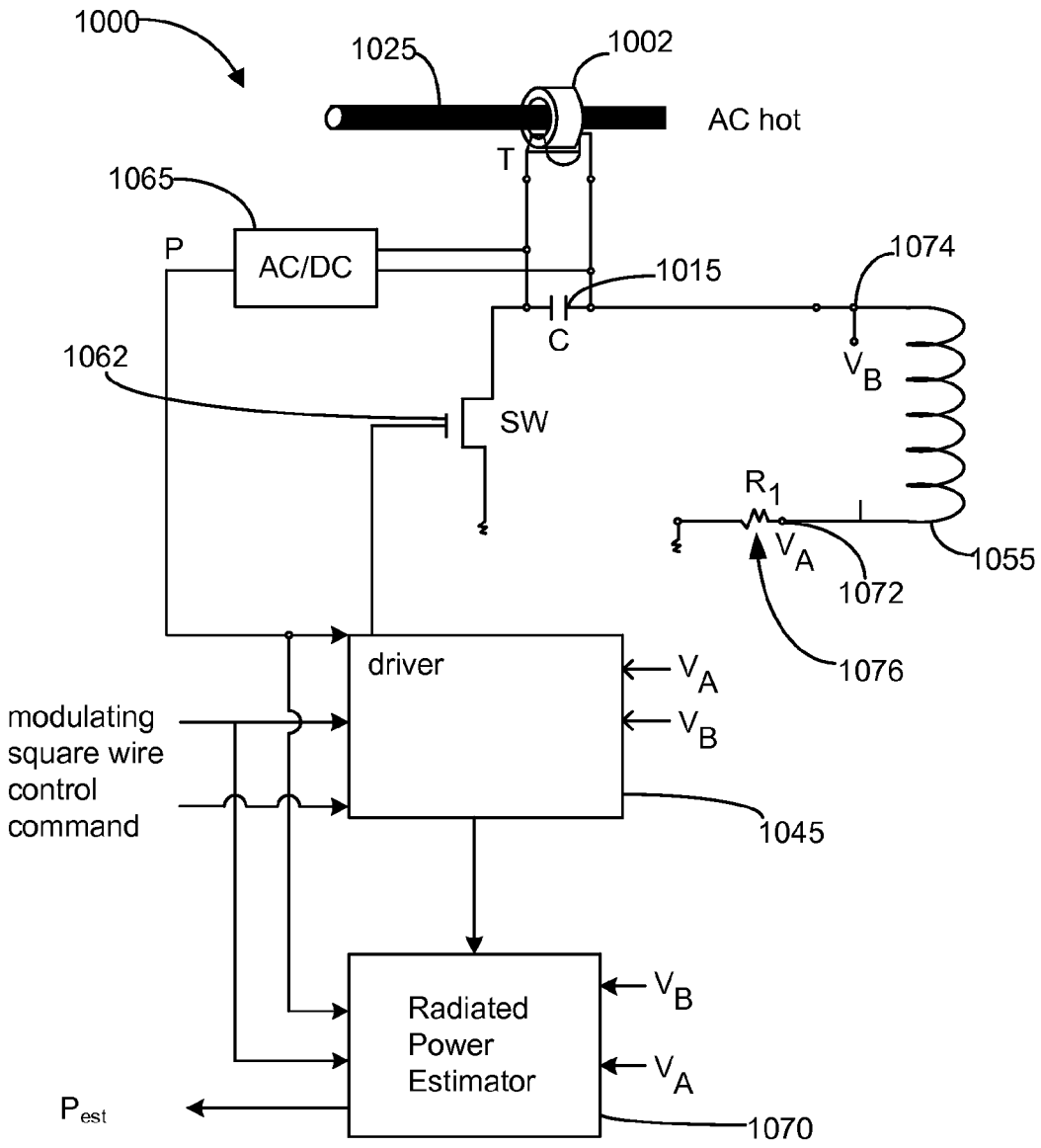
FIG. 10 is a schematic view of an impulse generator unit with a sensor, in accordance with at least one embodiment.

Referring now to FIG. 10, illustrated therein is an example embodiment of an impulse generator unit 1000 with a coil sensor. The delivery cable 1025, the toroid 1002, the capacitor 1015, the coil 1055 have been previously described. In this example, the AC/DC converter 1065 generates a regulated DC power supply voltage $V_{AC/DC}$ that is used to power the driver electronics as well as a computational block of a radiated power estimator 1070. $V_A$ is the voltage developed across a small resistor 1076, $R_1$, that is proportional to coil current. $V_3$ is the voltage at node 1074.

The driver block 1045 determines when to turn on and off the switch 1062 by analysing voltages $V_A$ and $V_B$, the modulating square wave, as well as control commands received from the controller 105 passed through the AC power line 1025 (via conducting cable 120) and coupled into an impulse generator unit 1000 via the coupler 1002. For example, this link may be bidirectional. In at least one embodiment, the switch 1062 may be implemented by a MOSFET.

Referring still to FIG. 10, the radiated power estimator 1070 may estimate the power radiated from the coil 1055. For example, the estimated power may be used in the overall reservoir mapping to estimate the temperature profile in the medium surrounding the down-hole RF heater 130.

In at least one embodiment, the apparatus may control the down-hole RF heater 130 based on feedback from a network of sensors. Extensive control of individual components of the impulse generator units may be implemented.

In at least one embodiment, the output of the sensors is digitized with the digitized sample values assembled into a data packet that is further augmented with error correction coding. This output of the sensors is then periodically transmitted to the surface controller 105 via the electrical power cable 125.

Figure 11A:
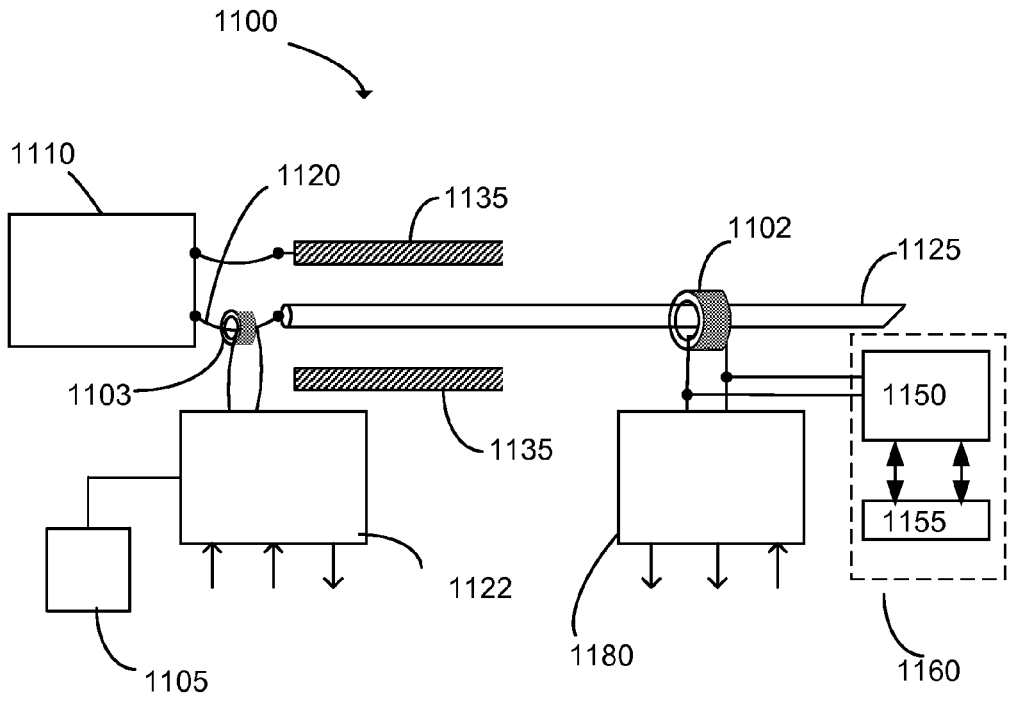
FIG. 11A is a schematic view of an apparatus for enhancing the extraction of hydrocarbons with a controller and a communication unit, in accordance with at least one embodiment.

Referring now to FIG. 11A, shown therein is an example embodiment of the apparatus 1100 for enhancing the extraction of the hydrocarbons using data communication units. A power source 1110, a pipe 1135, a delivery cable 1126, and a toroid 1102 have been described. For example, a control communication unit 1122 may be coupled into the conducting cable 1120 with data for N frequency conversion units, used in the apparatus, where N is an integer. The conducting cable 1120 then delivers this data to the delivery cable 1125. Inside the pipe 1135, the communication unit 1180 may be then coupled to the toroid 1102.

In at least one embodiment, a communication unit 1180 may receive data from the delivery cable 1125 and may transmit this data to a frequency conversion unit 1150. The modem 1180 may also receive data from the at least one sensor and may transmit the data via the delivery cable to the controlling communication unit 1122.

While there may be many individual communication units 1180, which need to communicate data to the modem 1122, the rate of communication required per each communication unit 1180 may be quite modest. For example, changes in the medium in terms of temperature and water desiccation have time constants of the order of hours.

In at least one embodiment, the delivery cable 1125 may be used as a communication line for the control signals sent to the individual impulse generator units 1160 from the surface by the controller 1105. In this example, the controller 1105 may be operationally coupled to the control communication unit 1122.

Figure 11B:
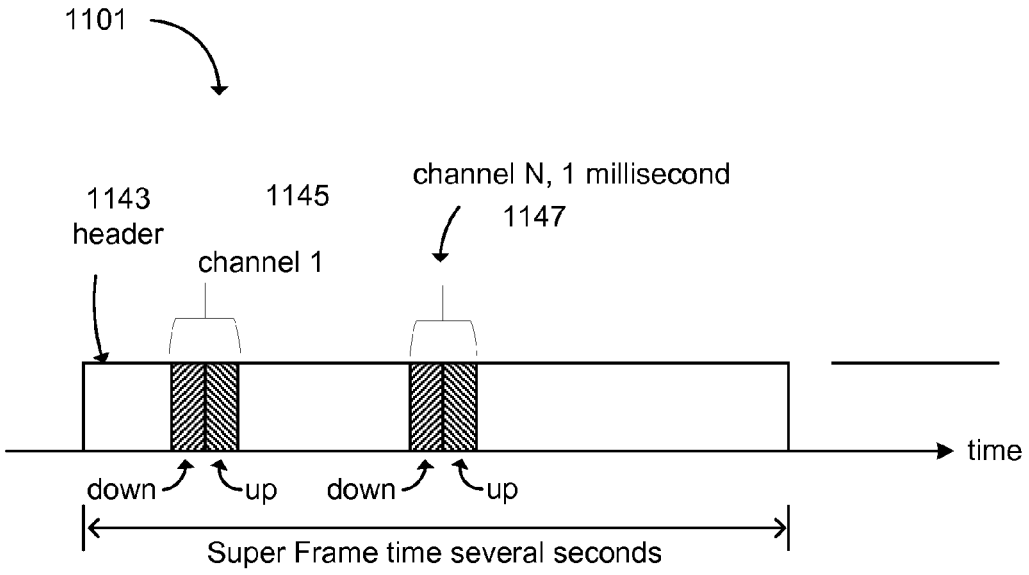
FIG. 11B is an illustration of an example of a power signal with characteristic data encoded within it, in accordance with at least one embodiment.

Referring now to FIG. 11B, shown therein is an illustration of an example of a power signal 1101 that has characteristic data encoded within it. In this example embodiment, the power signal comprises a header 1143 and a plurality of channels, wherein a first channel 1145 and the Nth channel 1147 are shown in FIG. 11B. For example, the header 1143 may be used for frame and clocking synchronization.

For example, the super frame time for all of the RF modules may be several seconds.

In at least one embodiment, the channel N may be a time slot of a 1 millisecond duration dedicated to the Nth impulse generator unit. The channel N may be divided into two halves for up link and down link traffic.

For example, the communication units 1122 and 1180 may be implemented by modems and have some protocol system. In at least one embodiment, a time division multiplex system may be used to transmit the data.

In at least one embodiment, modulation within the channel frame may be a robust modulation such as binary phase-shift keying (BPSK). Hence, for 10000 units the super frame duration may be of the order of 10 seconds long. A person skilled in the art will appreciate that reflections and frequency distortion may be overcome given the state of the art in the modern wireless and power line communications.

In at least one embodiment, the controller 1105 or the control communication unit 1110 may receive various data from the individual communication units 1180. For example, the controller 1105 may receive the data from at least one sensor described herein. The controller may further calculate various operational parameters to be transmitted down-hole to the individual impulse generation units 1160.

In at least one embodiment, the controller 1105 may also send various data to the individual communication units 1180 via the at least one control communication unit 1110. For example, the RE modulation may be enabled or disabled and the RE phase of the modulation and transition repetition rate may be set using this type of communication. The controller 1105 may determine and may send various operational parameters to the impulse generating units 1160. For example, a phase, a phase delay, a frequency (for example, the second frequency), a power level, and a pulse shape may be determined and transmitted to the at least one impulse generator unit 1160.

The data for each individual communication unit 1160 may be encoded in one power signal 1101, as described above. Therefore, when the apparatus comprises more than two impulse generator units 1160, the controller 1105 may independently adjust operational parameters of each of the at least two impulse generating units 1160, using the control communication unit 1122.

In at least one embodiment, a propagation constant as a function of the axial distance along the pipe 135 may be estimated with the tomographic sensing as described above, or with information provided by other sensors described above augmented with prior knowledge of the reservoir. Knowing the propagation constant, the phases and amplitudes of each of the impulse generator units 160 in an array of impulse generator units 160 may be set up to be commensurate with the phase and amplitudes of a desired distribution of voltage or current, or more generally, electric and magnetic fields of a guided or standing wave mode along the pipe 135.

Figure 12:
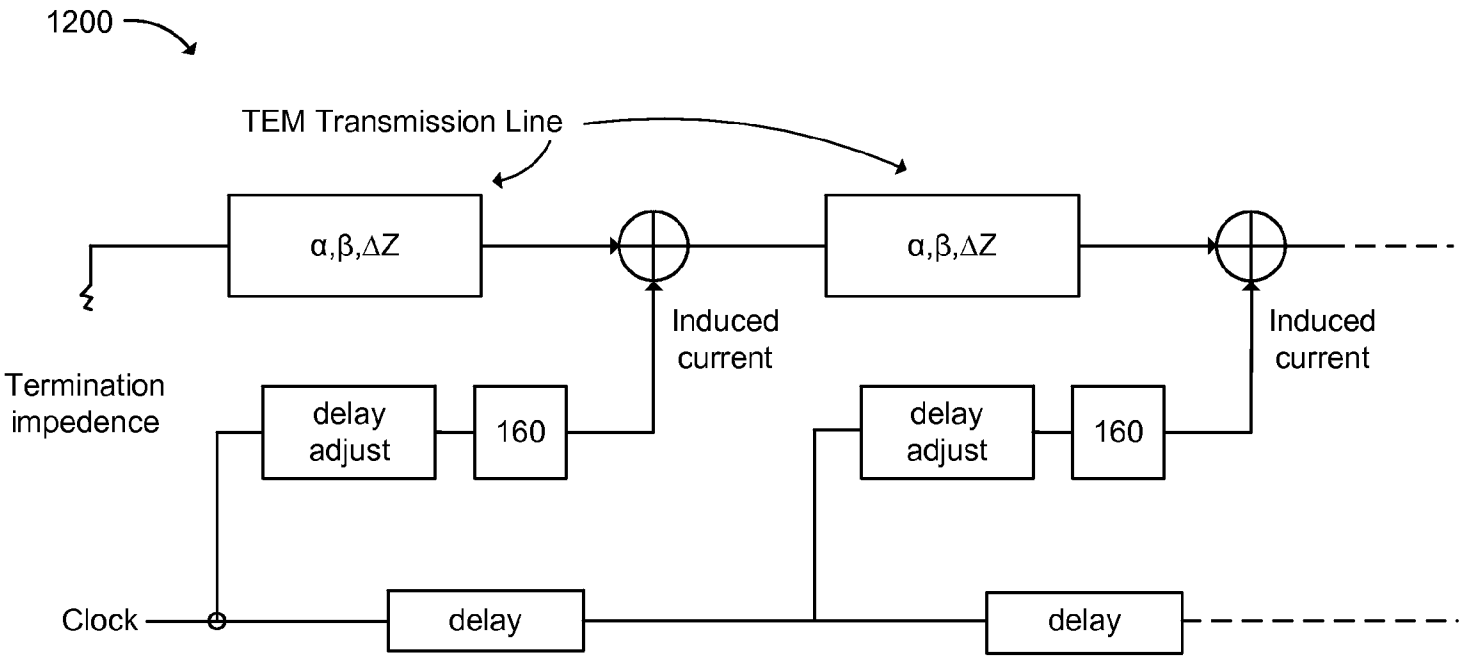
FIG. 12 is a travelling wave amplifier equivalent for the implementation scheme of building of the pseudo-transverse electric and magnetic mode (TEM) in the apparatus for enhancing the extraction of hydrocarbons from an underground reservoir using a well, in accordance with at least one embodiment.

For example, the amplitudes and phases of the impulse generator units 160 may be set up to establish a pseudo TEM (Transverse Electromagnetic Mode) along the pipe 135, which may radiate electromagnetic power into the formation 140. Referring to FIG. 12, the phase delay between consecutive impulse generator units 160 would be equal to the propagation constant $\beta$ (which may vary with the location along the pipe) multiplied by the distance $\Delta Z$ along the pipe between adjacent impulse generator units 160 (which may also vary along the pipe 135). In at least one embodiment, to maintain uniform radiation, the power radiated out along the distance $\Delta Z$ may be equal to the power added by an individual impulse generator unit 160 corresponding to that location along the pipe 135.

Figure 13A:
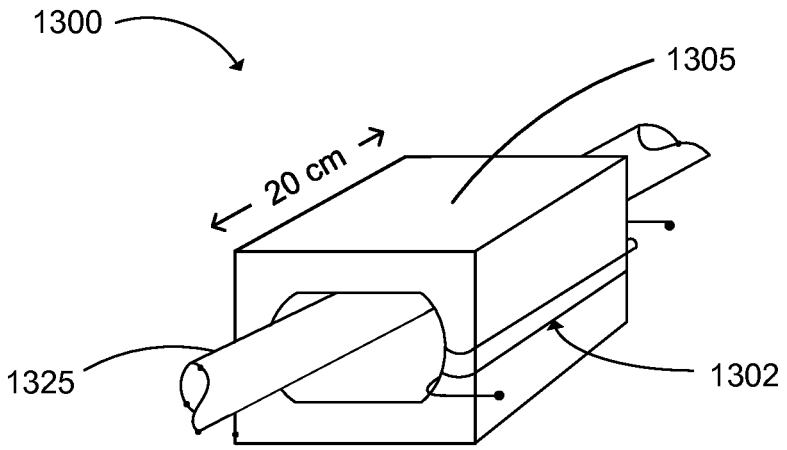
FIG. 13A is a schematic view of a coupling tap, in accordance with at least one embodiment.

Referring now to FIG. 13A, shown therein is an example embodiment of a coupling tap 1300. The coupling core 1305 may be positioned around the AC hot delivery cable 1325. In this example, there is no direct connection to the hot delivery cable that may carry approximately several thousand volts. The coupling core 1305 may be made, for example, of iron.

In at least one embodiment, each power tap may correspond to one impulse generator unit 160. Sets of taps 1300 may be optionally lumped together for a more convenient design.

For example, the core 1305 may have a length that is long enough to sufficiently couple most of the magnetic field in a section to the secondary winding 1302. For example, a small block of iron core may be sufficient for coupling of several hundred watts. The power of 250 W may be extracted from about 20 cm of the hot delivery cable 1325 using such inductive coupling. In at least one embodiment, the coupling cores with shorter lengths than 20 cm may be used in order to avoid single point of failure.

Figure 13B:
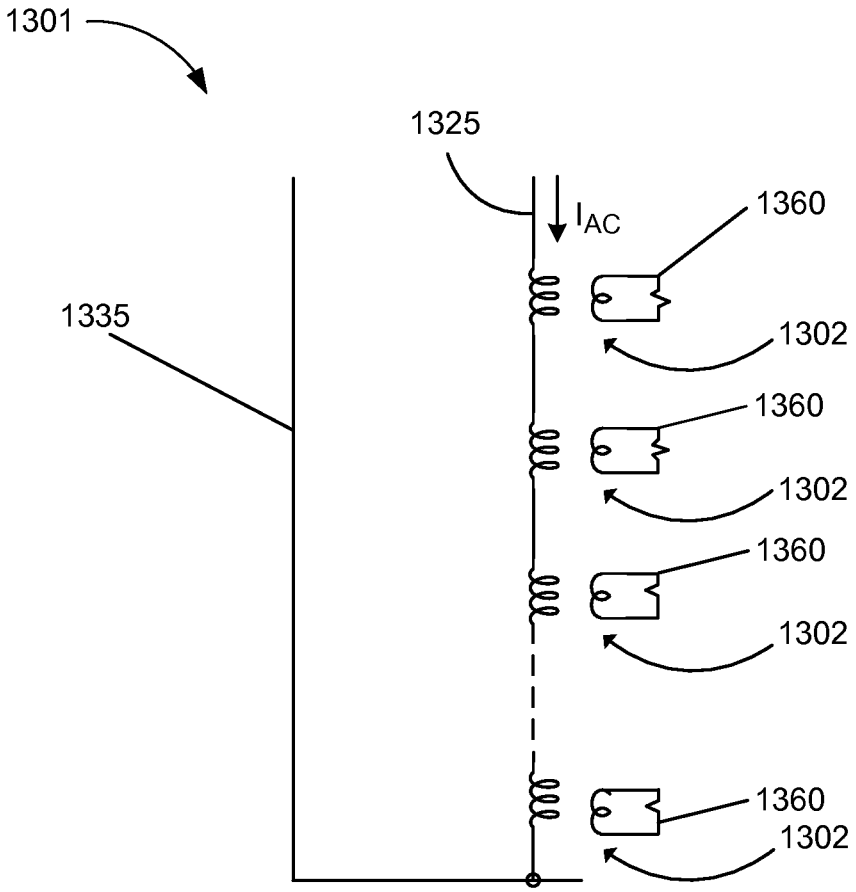
FIG. 13B is an implementation scheme of the downhole RF heater, in accordance with at least one embodiment.

It should be noted, that if the length of the core 1305 is short, then the AC magnetic lines may partially bypass the iron core section such that only a partial field coupling occurs. A core with an optimal length may be engineered to minimize the voltage drop due to the series inductor in the AC line. FIG. 13B illustrates an implementation scheme of the down-hole RF heater 1301 using the coupling taps 1300, according to at least one embodiment. In this example, secondary windings 1302 deliver power to impulse generator units 1360.

A number of embodiments have been described herein. However, it will be understood by persons skilled in the art that other variants and modifications may be made without departing from the scope of the embodiments as defined in the claims appended hereto.

The invention claimed is:

1. An apparatus for extraction of hydrocarbons from an underground reservoir using a well, the apparatus comprising:

a power source operable to supply periodic electrical power at a first frequency;

a group of impulse generator units comprising a first impulse generator unit and a second impulse generator unit, each impulse generator unit of the group of impulse generator units being located underground and having:

a first component operable to convert the periodic electrical power at the first frequency into periodic electrical power at a second frequency;

a second component operable to couple electromagnetic energy generated by the periodic electrical power at the second frequency into the reservoir, the second frequency being at least ten times higher than that of the first frequency; and a third component operable to control an operation of at least one of the first and second components; and a conducting cable operatively coupling the power source and the group of impulse generator units, each impulse generator unit of the group being coupled to the conducting cable along a portion of the cable between a first end and a second end;

wherein the third component of the first impulse generator unit is further operable to control the operation of at least one of the first and second components of each impulse generator unit of the group.

2. The apparatus of claim 1 wherein the first component comprises at least one frequency conversion unit operable to convert the periodic electrical power at the first frequency into periodic electrical power at the second frequency;

and the second component comprises at least one energy coupling unit operable to couple the electromagnetic energy generated by the periodic electrical power at the second frequency into the reservoir.

3. The apparatus of claim 2, further comprising a pipe;

wherein:

at least one portion of the conducting cable is contained within the pipe; and at least one portion of each of the at least one energy coupling unit is outside of the pipe.

4. The apparatus of claim 3, wherein at least a portion of the power source is located outside of the well and at least a portion of the pipe is contained within the well.

5. The apparatus of claim 3, wherein the pipe comprises at least two pipe modules joined together to form the pipe; and each of the at least two pipe modules comprises at least one impulse generator unit.

6. The apparatus of claim 3 further comprising at least one cladding material between the pipe and the at least one energy coupling unit.

7. The apparatus of claim 3, wherein a return path for the conducting cable to the power source is selected from a group consisting of:

the pipe, a first end of the pipe being operatively coupled to the power source and a second end of the pipe being operatively coupled to the conducting cable;

the reservoir, the reservoir being operatively coupled to the conducting cable and the power source; and a secondary return cable, the secondary return cable being operatively coupled to the conducting cable and the reservoir.

8. The apparatus of claim 2, wherein the frequency conversion unit comprises:

a switch operable to control the energy coupling unit;

a driver circuit operable to drive state transitions of the switch; and a bypass capacitor.

9. The apparatus of claim 2 further comprising a controller configured to adjust at least one operational parameter of the group of impulse generator units.

10. The apparatus of claim 9 wherein each of the at least one operational parameter is selected from a group consisting of: an enable parameter, a disable parameter, a phase, a phase delay, the second frequency, a power level, and a pulse shape.

11. The apparatus of claim 2 wherein the apparatus comprises a controller operable to independently set at least one operational parameter of each impulse generator unit of the group.

12. The apparatus of claim 1, wherein the first frequency is between about 0 Hz and about 1000 Hz and the second frequency is between about 10 kHz and about 100 MHz.

13. The apparatus of claim 1, further comprising at least one sensor, operable to generate a sensor output data, the sensor output data being used to adjust at least one operational parameter of the group of impulse generator units.

14. The apparatus of claim 13, wherein the sensor output data comprises at least one sensor output data value, each sensor data output value corresponds to one of: a temperature, a pressure, a voltage, a current, a status, an impedance, permittivity, an electromagnetic field, a magnetic field and an electric field.

15. The apparatus of claim 13, further comprising a controller, operable to receive the sensor output data and to adjust the at least one operational parameter of the group of impulse generator units, based on the sensor output data.

16. The apparatus of claim 15, wherein the third component of each impulse generator unit of the group comprises:

at least one communication unit associated with the group of impulse generator units, the at least one communication unit being configured to receive the sensor output data and to transmit the sensor output data to the controller.

17. The apparatus of claim 16, wherein the at least one communication unit and the controller are both operatively coupled to the conducting cable; and the controller is operable to communicate with the at least one communication unit using the conducting cable.

18. A method for extraction of hydrocarbons from an underground reservoir using a well, the method comprising:

supplying, using a conducting cable, periodic electrical power at a first frequency to a group of impulse generator units comprising a first impulse generator and a second impulse generator unit, each impulse generator unit of the group being located underground and coupled to the conducting cable at a portion of the cable between a first end and a second end; and for each impulse generator unit of the group:

operating a first component of the impulse generator unit to convert the supplied periodic electrical power at the first frequency to a periodic electrical power at a second frequency, the second frequency being at least ten times higher that of the first frequency;

operating a second component of the impulse generator unit to couple electromagnetic energy generated by the periodic electrical power at the second frequency into the reservoir; and operating a third component of the impulse generator unit to control an operation of at least one of the first and second components; and operating the third component of the first impulse generator unit to control an operation of at least one of the first and second components of each impulse generator unit of the group.

19. The method of claim 18, wherein the method further comprises:

setting at least one operational parameter of the group of impulse generator units using a controller and sending the at least one operational parameter to the third component of the first impulse generator unit.

20. The method of claim 19 wherein each of the at least one operational parameter is selected from a group consisting of: an enable parameter, a disable parameter, a phase, a phase delay, the second frequency, a power level, and a pulse shape.

21. The method of claim 18, wherein the method further comprises, for each impulse generator unit of the group:

measuring a sensor data;

setting at least one operational parameter of the group of impulse generator units based on the sensor data and sending the at least one operational parameter to the third component of the first impulse generator unit.

22. The method of claim 21, wherein the sensor data comprises at least one sensor data value, each sensor data value corresponds to one of: a resistance, a temperature, a pressure, a voltage, a current, a status, an impedance, an electric field, a magnetic field and an electromagnetic field.

23. The method of claim 22, wherein the method further comprises:

independently setting at least one operational parameter of the group of impulse generator units.

24. The method of claim 18, wherein the method further comprises, for each impulse generator unit of the group:

transmitting sensor data from at least one sensor;

receiving the sensor data; and setting operational parameters of the group of impulse generator units based on the received sensor data and sending the at least one operational parameter to the third component of the first impulse generator unit.

25. The method of claim 18, wherein the method further comprises measuring a sensor data, the sensor data comprising at least one of a resistance, a temperature, a pressure, a voltage, a current, a status, an impedance, an electric field, a magnetic field and an electromagnetic field;

determining at least one property of the reservoir based on the measured sensor data, each of the at least one property corresponds to one of a dielectric property of the reservoir and a propagation property of the electromagnetic field in the reservoir; and adjusting at least one operational parameter of the group of impulse generator units based on the at least one property of the reservoir.

26. An apparatus for extraction of hydrocarbons from an underground reservoir using a well, the apparatus comprising:

a power source operable to supply periodic electrical power;

a pipe;

a group of impulse generator units comprising at least two impulse generator units, each impulse generator unit of the group being located underground and having:

a first component operable to couple electromagnetic energy generated by the periodic electrical power at a radio frequency into the reservoir, at least one portion of the first component being outside of the pipe; and a second component operable to control an operation of at least the first component; and a conducting cable operatively coupling the power source and the group of impulse generator units, each impulse generator unit of the group being coupled to the conducting cable along a portion of the cable between a first end and a second end, at least one portion of the conducting cable being contained within the pipe.

27. The apparatus of claim 26 further comprising a controller operable to independently adjust at least one operational parameter of each impulse generator unit of the group using the second component of that impulse generator unit.

28. The apparatus of claim 27, further comprising at least one sensor, operable to generate a sensor output, the sensor output being used to independently adjust the at least one operational parameter of the group of impulse generator units.

29. The apparatus of claim 27 wherein the at least one operational parameter comprises at least one of a power level, a phase and a phase delay of the periodic electrical power at the radio frequency.

30. A method for extraction of hydrocarbons from an underground reservoir using a well, the method comprising:

supplying, using a conducting cable, periodic electrical power to a group of impulse generator units, each impulse generator unit of the group being located underground and coupled to the conducting cable at a portion of the cable between a first end and a second end, at least a portion of the conducting cable being contained within a pipe; and for each impulse generator unit of the group:

operating a first component of the impulse generator unit to couple electromagnetic energy generated by the periodic electrical power at a radio frequency into the reservoir, wherein at least one portion of the first component is outside of the pipe; and operating a second component of the impulse generator unit to adjust at least one operational parameter of the impulse generator unit, the at least one operational parameter being independently adjustable relative to another impulse generator unit in the group of impulse generator units.

31. The method of claim 30, wherein the method further comprises:

measuring a sensor data; and independently adjusting the at least one operational parameter of each impulse generator unit of the group based on the sensor data using a respective second component.

32. The method of claim 30 wherein each of the at least one operational parameter is selected from a group consisting of: a power level, phase and a phase delay of the periodic electrical power at the radio frequency.

* * * * *